US007299648B2

(12) United States Patent
Kim

(10) Patent No.: US 7,299,648 B2
(45) Date of Patent: Nov. 27, 2007

(54) REFRIGERATION SYSTEM OF AIR CONDITIONING APPARATUSES WITH BYPASS LINE BETWEEN INLET AND OUTLET OF COMPRESSOR

(75) Inventor: Young-Taek Kim, Anyang-si (KR)

(73) Assignee: Patentbank Co., Ltd., Busan-Si (KR)

( * ) Notice: Subject to any disclaimer, the term of this patent is extended or adjusted under 35 U.S.C. 154(b) by 190 days.

(21) Appl. No.: 10/542,788

(22) PCT Filed: Sep. 2, 2003

(86) PCT No.: PCT/KR03/01794

§ 371 (c)(1),
(2), (4) Date: Jul. 20, 2005

(87) PCT Pub. No.: WO2005/017422

PCT Pub. Date: Feb. 24, 2005

(65) Prior Publication Data

US 2006/0065003 A1 Mar. 30, 2006

(30) Foreign Application Priority Data

Jul. 31, 2003 (KR) ..... 10-2003-0053062

(51) Int. Cl.
*F25B 13/00* (2006.01)
*F25B 41/00* (2006.01)

(52) U.S. Cl. ..... 62/324.1; 62/513

(58) Field of Classification Search ..... 62/196.3, 62/117, 324.1, 513, 197, 156, 228.3, 160, 62/238.7

See application file for complete search history.

(56) References Cited

U.S. PATENT DOCUMENTS 2,579,439 A * 12/1951 Noe ..... 137/107
2,875,592 A * 3/1959 Olsen ..... 62/192
2,936,594 A * 5/1960 Jacobs ..... 62/156
2,981,076 A * 4/1961 Gaugler et al. ..... 62/208
3,111,815 A * 11/1963 Roberts ..... 62/196.4
3,126,713 A * 3/1964 Parker ..... 62/117
3,130,558 A * 4/1964 Gardner ..... 62/197
4,230,470 A 10/1980 Matsuda et al.
4,441,335 A * 4/1984 Bonne ..... 62/324.6
5,167,491 A * 12/1992 Keller et al. ..... 417/28
5,737,931 A 4/1998 Ueno et al.
5,987,907 A 11/1999 Morimoto et al.
6,085,533 A * 7/2000 Kaido et al. ..... 62/196.2
6,305,187 B1 10/2001 Tsuboe et al.

FOREIGN PATENT DOCUMENTS

JP 5-296579 A * 11/1993
WO 0225185 A1 3/2002

* cited by examiner

*Primary Examiner*—Mohammad M. Ali
(74) *Attorney, Agent, or Firm*—Arent Fox LLP

(57) ABSTRACT

A refrigeration system of air conditioning apparatuses with a bypass line between the inlet and outlet of a compressor. The refrigeration system (1) has an expansion unit (10) to execute adiabatic expansion of refrigerant, an indoor unit (20) with a heat exchanger, a compressor (30) to execute adiabatic compression of the refrigerant, and an outdoor unit (40) with a heat exchanger, and is operated to cool or heat air within a space to a desired level by using the phase change of the refrigerant. The refrigeration system also has a bypass line (99) between the inlet and outlet of the compressor (30) to bypass at least a part of the output refrigerant from the outlet to the inlet of the compressor when the pressure of the output refrigerant is lower than a reference level or the temperature of the air outside the compressor is lower than a reference level.

9 Claims, 20 Drawing Sheets

REFRIGERATION SYSTEM OF AIR CONDITIONING APPARATUSES WITH BYPASS LINE BETWEEN INLET AND OUTLET OF COMPRESSOR

CROSS-REFERENCE TO RELATED APPLICATION

This application is a National Stage entry of International Application No. PCT/KR2003/001794, filed Sep. 2, 2003, the entire specification claims and drawings of which are incororated herewith by reference.

TECHNICAL FIELD

The present invention relates, in general, to a refrigeration system of an air conditioning apparatus, and more particularly to a refrigeration system of an air conditioning apparatus with a bypass line connected between an inlet and an outlet of a compressor, which is adapted to supply a part or all of refrigerant discharged from a compressor back to the compressor again, to compress the refrigerant.

BACKGROUND ART

Generally, a refrigeration system of an air conditioning apparatus performs cooling and heating operations in such a way that the air conditioning apparatus absorbs heat from the air in a space to be air conditioned and discharges the heat outside the space, or the air conditioning apparatus absorbs heat from the outside air of the space to be air conditioned and supplies the heat into the space, by using the phase change of refrigerant.

The refrigerant is circulated in a circulation cycle comprised of evaporation—compression—condensation—expansion—evaporation during the cooling operation, while the refrigerant is circulated in a circulation cycle comprised of evaporation—expansion—condensation—compression—evaporation during the heating operation.

Such a refrigeration system of an air conditioning apparatus commonly includes a cooling system which is designed to lower a temperature of air in a space to be air conditioned (because the space to be air conditioned is generally a room, the space will be referred to as a room while the outside of the space to be air conditioned will be merely referred to as the outside of the room hereinafter, for the sake of convenience in explanation), a heating system which is designed to raise a temperature of air in the room, and a cooling and heating system which is designed to lower or raise a temperature of air in the room according to a user's selection.

A conventional refrigeration system includes an indoor unit installed in the room, an outdoor unit installed outside the room, a compressor which draws refrigerant in a state of lower temperature and lower pressure, compresses the refrigerant under the adiabatic condition to cause the refrigerant to have higher temperature and higher pressure, and discharges the refrigerant in the state of higher temperature and higher pressure, an expansion unit which allows for expansion of the refrigerant in a state of higher temperature and higher pressure under the adiabatic condition to cause the refrigerant to have lower temperature and lower pressure, and discharges the refrigerant in the state of lower temperature and lower pressure, a piping to connect the indoor unit, the outdoor unit, the compressor and the expansion unit to each other to allow the refrigerant to be circulated in a predetermined circulating path, various sensors provided at predetermined positions to monitor a temperature, a pressure and the like of the refrigerant, and a control unit to allow electricity to be supplied to the components such as compressor and the sensors and controls operations of the components such as the compressor, based on information received from the sensors. The refrigeration system further includes valves to change a circulating path of the refrigerant.

An operation of cooling a room by a cooling system or a heating system, and an operation of heating a room by a heating system or a cooling and heating system will now be described in detail.

In a cooling operation, liquid refrigerant in a state of lower temperature and lower pressure, which is introduced into the indoor unit, and then discharged to the compressor. The refrigerant in the state of lower temperature and lower pressure is compressed in the compressor, resulting in the refrigerant in higher temperature and higher pressure, and the refrigerant in higher temperature and higher pressure is discharged as gaseous refrigerant. The gaseous refrigerant in the state of higher temperature and higher pressure, which is discharged from the compressor, is introduced into the outdoor unit, and then condensed into liquid refrigerant in a state of higher temperature and higher pressure while radiating heat outside the room. The condensed liquid refrigerant is discharged to the expansion unit. The liquid refrigerant in a state of higher temperature and higher pressure, which is introduced into the expansion unit, is expanded, resulting in liquid refrigerant in a state of lower temperature and lower pressure, and then discharged to the indoor unit. As such, the refrigerant is circulated in the circulating cycle in the above-mentioned manner.

In a heating operation, gaseous refrigerant in a state of higher temperature and higher pressure, which is introduced into the indoor unit, is condensed into liquid refrigerant in a state of higher temperature and higher pressure while radiating heat to the room, and then discharged to the expansion unit. The liquid refrigerant in the state of higher temperature and higher pressure, which is introduced into the indoor unit, is expanded, resulting in liquid refrigerant in a state of lower temperature and lower pressure, and then discharged to the outdoor unit. The liquid refrigerant in the state of lower temperature and lower pressure, which is introduced into the outdoor unit, evaporates while absorbing heat from the outside air of the room, resulting in gaseous refrigerant in a state of lower temperature and lower pressure, and then discharged to the compressor. The gaseous refrigerant, which is introduced into the compressor from the outdoor unit, is compressed into gaseous refrigerant in a state of higher temperature and higher pressure, and then discharged to the indoor unit. As such, the refrigerant is circulated in the circulating cycle in the above-mentioned manner.

In the above conventional refrigeration system of air conditioning apparatus, the refrigerant into the compressor and the refrigerant discharged from the compressor must be maintained in a preset range in order to execute appropriate cooling and heating operations in the optimal circulation cycle without possible damage to the compressor.

It is preferable to control a temperature of the refrigerant, which is introduced into the compressor, to be slightly higher than that of a saturated refrigerant in which gaseous refrigerant and liquid refrigerant exist together, thereby allowing only gaseous refrigerant to exist in the compressor. This is because a compression capability of the compressor is lowered and the components of the compressor are damaged in a case that the liquid refrigerant is introduced into the compressor. Furthermore, when a temperature of the refrigerant, which is introduced into the compressor, is excessively raised compared to that of the saturated refrigerant in which gaseous refrigerant and liquid refrigerant exist together, the components of the compressor are deteriorated, thereby causing a service life and compression efficiency of the compressor to be drastically shortened and lowered.

Of the above problems, the former problem can be overcome by a simple method of supplying gaseous refrigerant separated through a gas-liquid separator to the compressor. The latter problem can be overcome by a method of lowering a temperature of refrigerant introduced into the compressor to prevent a temperature of the refrigerant from excessively rising than a temperature of the saturated refrigerant in which gaseous refrigerant and liquid refrigerant exist together, thereby lowering a compression load of the compressor, as disclosed in Korean Patent Application Nos. 2000-56277, 2000-56278 and 2000-56279.

Meanwhile, when a pressure of refrigerant, which is introduced into or discharged from the compressor, is excessively lowered, or an outside temperature of the compressor is excessively lowered, there are various problems, such as condensation on the compressor and malfunction of cooling and heating operations. However, methods of solving these problems are not proposed in any documents.

DISCLOSURE OF THE INVENTION

Accordingly, the present invention has been made keeping in mind the above problems occurring in the prior art, and an object of the present invention is to provide a refrigeration system of an air conditioning apparatus with a bypass line connected between an inlet and an outlet of a compressor, which is adapted to supply a part or all of refrigerant discharged from a compressor to the compressor again to maintain a pressure of the refrigerant discharged from the compressor in a normal level, when a pressure of the refrigerant discharged from the compressor or an outside temperature of the compressor is lower than a preset range.

In order to accomplish the above object, the present invention provides a refrigeration system of an air conditioning apparatus to cool or heat air within a space by using phase change of refrigerant, the refrigeration system including an expansion unit to execute adiabatic expansion of refrigerant, an indoor unit with a heat exchanger, a compressor to execute adiabatic compression of the refrigerant, an outdoor unit with a heat exchanger, and a bypass line connected between an inlet and an outlet of the compressor to bypass at least a part of the refrigerant discharged from the outlet of the compressor to the inlet of the compressor, when a pressure of the discharged refrigerant is lower than a preset level or the temperature of outside air of the compressor is lower than a preset level.

Refrigerant in condensed in the indoor unit or the outdoor unit may be introduced into the expansion unit through at least one auxiliary evaporator for heat exchange, and a part of the refrigerant to be introduced into the expansion unit is expanded in at least one auxiliary expansion unit under the adiabatic condition, and supplied to the compressor through the auxiliary evaporator for heat exchange.

Refrigerant condensed in the indoor unit or the outdoor unit may be introduced into the expansion unit through at least one auxiliary evaporator for heat exchange, in which a part of the refrigerant to be introduced into the expansion unit is expanded in at least one auxiliary expansion unit under the adiabatic condition, and the refrigerant discharged from the at least one auxiliary expansion unit is mixed with the refrigerant evaporated in the outdoor or the indoor, and supplied to the compressor through the at least one auxiliary evaporator.

Refrigerant condensed in the indoor unit or the outdoor unit may be introduced into the expansion unit through at least one auxiliary evaporator for heat exchange, in which a part of the refrigerant to be introduced into the expansion unit is expanded in at least one auxiliary expansion unit under the adiabatic condition, and the refrigerant discharged from the at least one auxiliary expansion unit and subjected to heat exchange in the at least one auxiliary evaporators is mixed with the refrigerant evaporated in the outdoor or the indoor and subjected to heat exchange in the expansion unit, and supplied to the compressor.

Refrigerant condensed in the indoor unit or the outdoor unit may be introduced into the expansion unit through at least one auxiliary evaporator for heat exchange, in which a part of the refrigerant to be introduced into the expansion unit is expanded in at least one auxiliary expansion unit under the adiabatic condition, and the refrigerant discharged from the at least one auxiliary expansion unit is mixed with the refrigerant evaporated in the outdoor or the indoor and subjected to heat exchange in the expansion unit, and supplied to the compressor.

The at least one auxiliary evaporator for heat exchange may be comprised of a plurality of auxiliary evaporators which are connected to each other in series or in parallel with respect to flow of the refrigerant.

The at least one auxiliary expansion unit may be comprised of a plurality of auxiliary expansion units which are connected to each other in series or in parallel with respect to the flow of the refrigerant.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
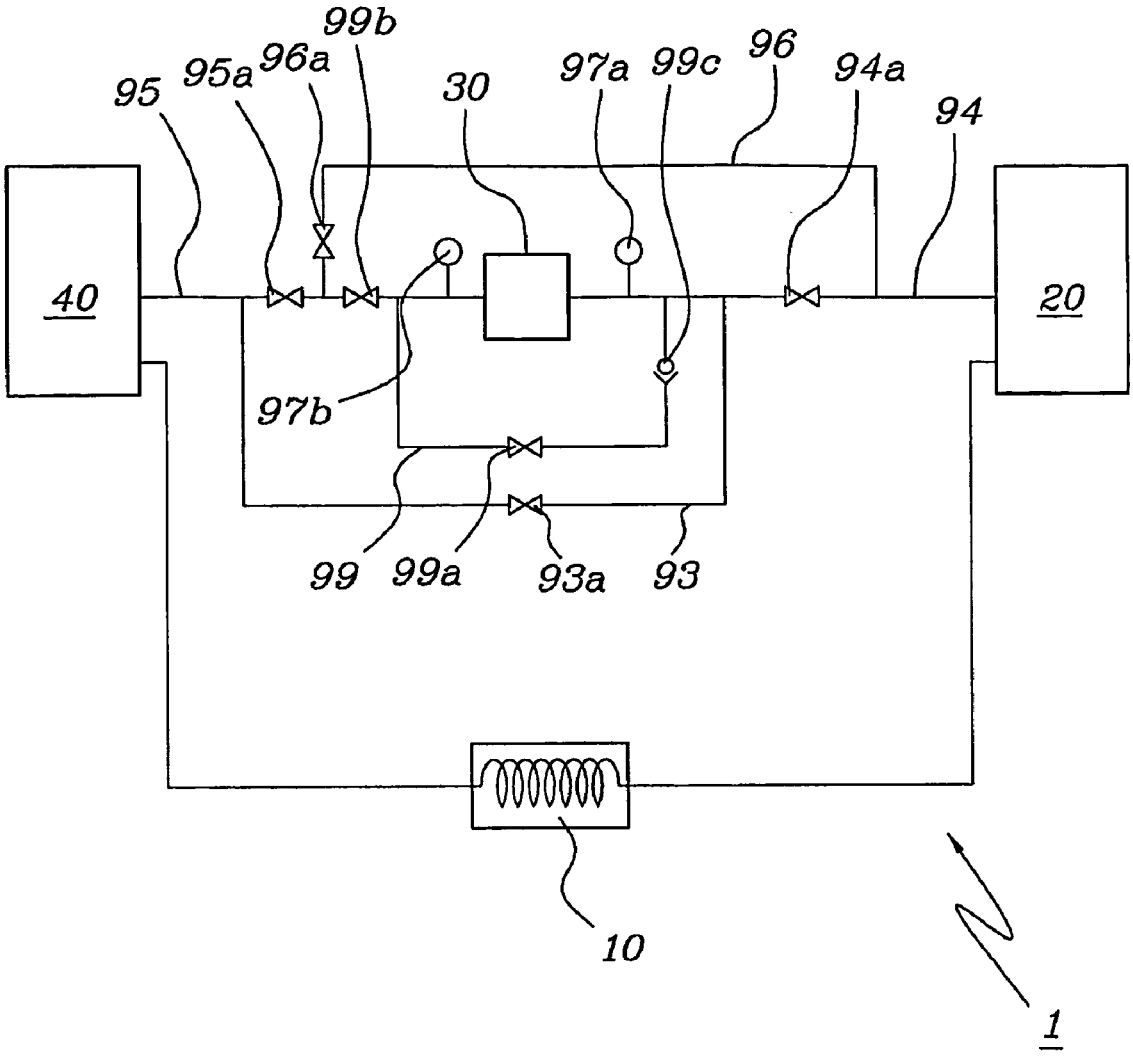
FIG. 1 is a circuit diagram showing a refrigeration system of an air conditioning apparatus with a bypass line connected between an inlet and an outlet of a compressor, according to a first embodiment of the present invention.

Reference should now be made to the drawings, in which the same reference numerals are used throughout the different drawings to designate the same or similar components.

FIG. 1 shows a refrigeration system of an air conditioning apparatus with a bypass line connected between an inlet and an outlet of a compressor, according to a first embodiment of the present invention.

As shown in FIG. 1, the refrigeration system 1 according to this embodiment includes an expansion unit 10, which allows refrigerant in a state of higher temperature and higher pressure, which is introduced thereinto, to be expanded under an adiabatic condition, resulting in refrigerant in a state of lower temperature and lower pressure, and then discharges the refrigerant, an indoor unit 20 installed in the room and having a heat exchanger therein, a compressor 30 which compresses lower pressure refrigerant under an adiabatic condition and discharges the refrigerant, and an outdoor unit 40 installed outside the room and having a heat exchanger therein. An inlet and an outlet of the compressor 30 are connected to a first compressor line 94 and a second compressor line 95, respectively. The first and second compressor lines 94 and 95 are provided with pressure gauges 97*a* and 97*b*, respectively, which detect a pressure of refrigerant introduced into the compressor 30 and a pressure of refrigerant discharged from the compressor 30, respectively. A thermometer (not shown) is mounted on an outer surface of the compressor 30 to measure an outside temperature of the compressor 30.

The expansion unit 10, the indoor unit 20, the compressor 30 and the outdoor unit 40 are connected to each other via lines and valves to form a refrigerant-circulating path for cooling and heating operations. More specifically, one end of a first refrigerant line 93 is connected to the portion of the first compressor line 94 positioned between the indoor unit 20 and the pressure gauge 97*a*, while the other end of the first refrigerant line 93 is connected to the portion of the second compressor line 95 positioned between the outdoor unit 40 and the pressure gauge 97*b*. One end of a second refrigerant line 96 is connected to the portion of the first compressor line 94 positioned between the indoor unit 20 and the pressure gauge 97*a*, while the other end of the second refrigerant line 96 is connected to the portion of the second compressor line 95 positioned between the outdoor unit 40 and the pressure gauge 97*b*. The first and second refrigerant lines 93 and 96 are provided with ON/OFF valves 93*a* and 96*a*, respectively, to permit or block flow of refrigerant therethrough. The first compressor line 94 and the second compressor line 95 are provided with ON/OFF valves 94*a* and 95*a*, respectively, which are positioned between the connecting ends of the first refrigerant line 93 and the connecting ends of the second refrigerant line 96, to permit or block flow of refrigerant therethrough.

The refrigeration system 1 according to the first embodiment includes a bypass line 99, which is connected at its one end to the portion of the second compressor line 95 positioned between the pressure gauge 97*b* and the second refrigerant line 96, and connected at the other end to the portion of the first compressor line 94 positioned between the pressure gauge 97*a* and the first refrigerant line 93, so as to direct a part or all of refrigerant discharged from the compressor 30 from the portion of the second compressor line 95 to the portion of the first compressor line 94, thereby enabling the refrigerant to be introduced into the compressor 30 again. The refrigerant bypass line 99 is provided with a bypass valve 99*a*, to permit or block flow of refrigerant therethrough, and to control a flow rate of the refrigerant, if required. The second compressor line 95 is provided with a flow control valve 99*b* between the refrigerant bypass line 99 and the second refrigerant line 96, to control a flow rate of refrigerant, and to permit or block flow of the refrigerant therethrough, if required. The refrigerant bypass line 99 further includes a check valve 99*c* to prevent refrigerant introduced into the compressor 30 from flowing back to the refrigerant bypass line 99.

A control unit (not shown), which is intended to control the refrigeration system 1 according to the first embodiment of the present invention, is provided at a preset position, for example, in the indoor unit 20. The control unit controls fans, valves and the like of the compressor, the indoor unit and the outdoor unit based on information received from sensors such as the pressure gauges 97*a* and 97*b*, so as to permit circulation of refrigerant for a cooling operation or a heating operation.

Figure 4:
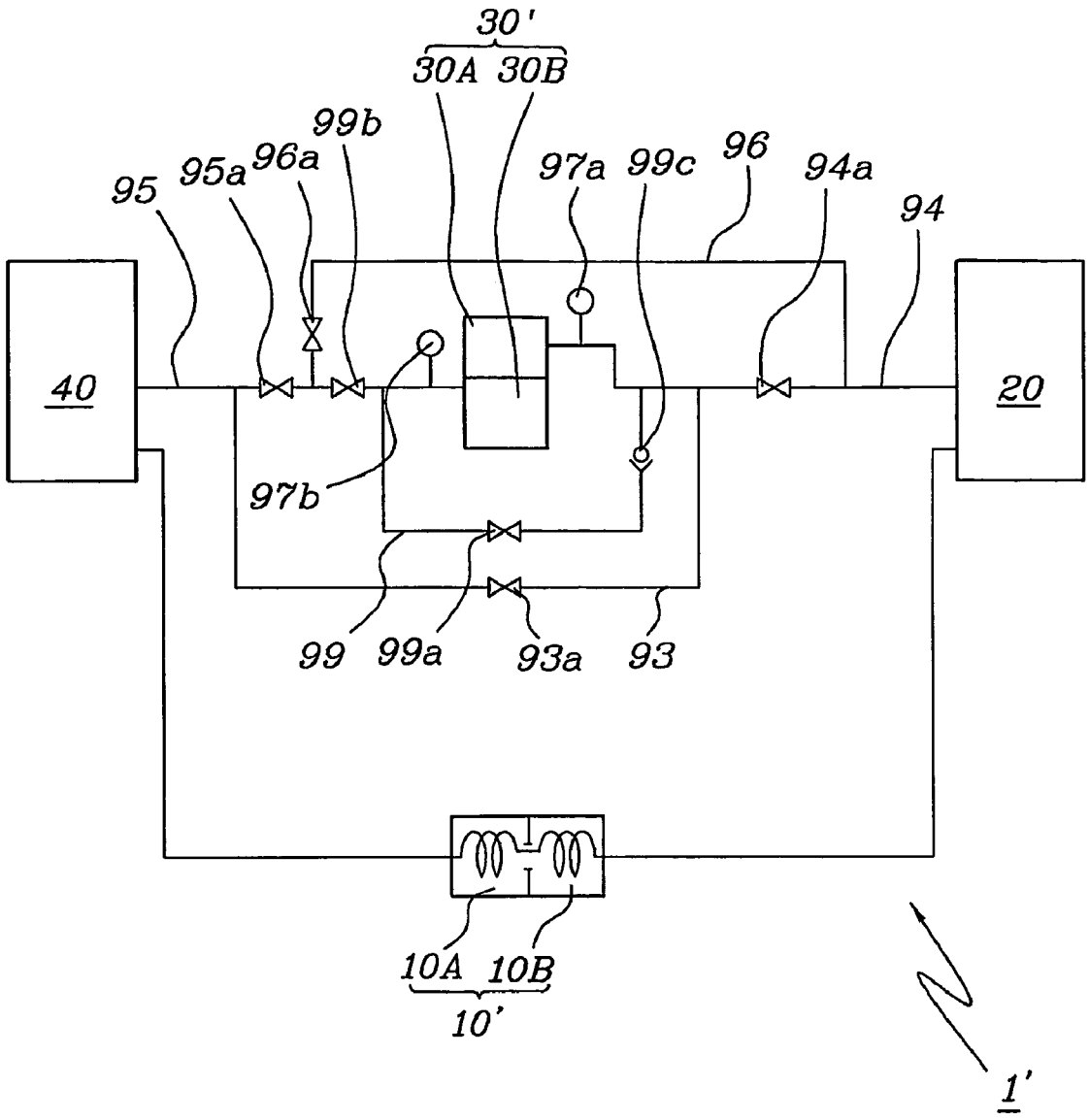
FIG. 4 is a circuit diagram showing a modification of the refrigeration system of FIG. 1.

FIG. 4 shows a modification of the first embodiment of the present invention shown in FIG. 1. In a description of the modification shown in FIG. 4, a description relating to the same parts as those of the embodiment shown in FIG. 1 is omitted, and only a description relating to parts different from those of the embodiment of FIG. 1 is disclosed herein.

In this modification, the expansion unit 10 of the first embodiment shown in FIG. 1 is substituted with an expansion complex 10' comprised of a plurality of expansion units 10A and 10B, which are arranged in series or in parallel with respect to the refrigerant path, and the compressor 30 of the first embodiment shown in FIG. 1 is substituted with a compressor complex 30' comprised of a plurality of compressors 30A and 30B, which are arranged in series or in parallel with respect to the refrigerant path.

According to this modification, the refrigeration system 1' can increase expansion and compression capabilities with the aid of the expansion complex 10' comprised of a plurality of expansion units 10A and 10B and the compressor complex 30' comprised of a plurality of compressors 30A and 30B, and also can alleviate expansion and compression loads of the respective expansion units 10A and 10B and the respective compressors 30A and 30B.

Figure 5:
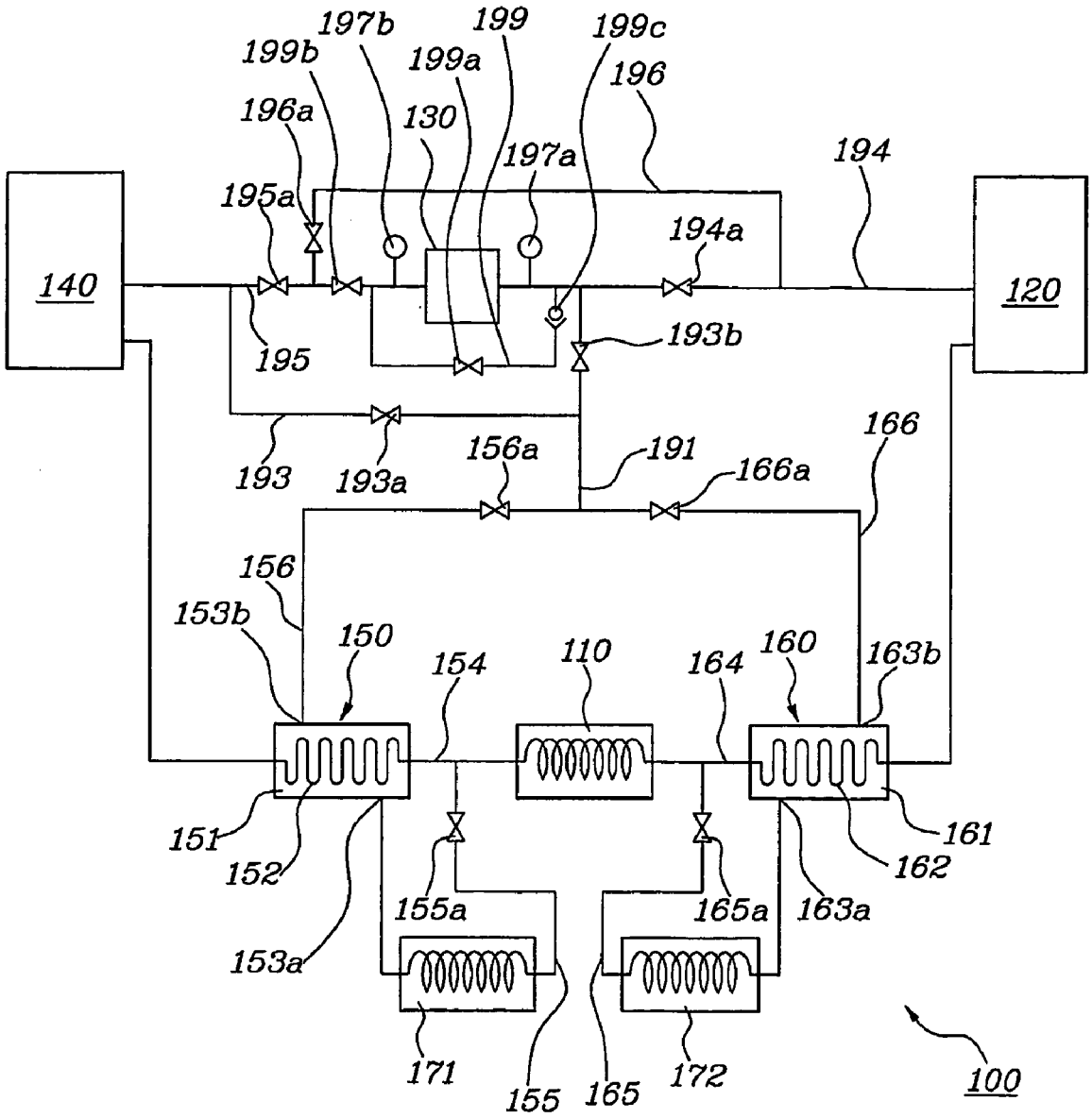
FIG. 5 is a circuit diagram showing a refrigeration system of an air conditioning apparatus with a bypass line connected between an inlet and an outlet of a compressor, according to a second embodiment of the present invention.

FIG. 5 shows a refrigeration system of an air conditioning apparatus with a bypass line connected between an inlet and an outlet of a compressor, according to a second embodiment of the present invention.

As shown in FIG. 5, the refrigeration system 100 according to the second embodiment includes an expansion unit 110, which allows refrigerant in a state of higher temperature and higher pressure, which is introduced thereinto, to be expanded under an adiabatic condition, resulting in refrigerant in a state of lower temperature and lower pressure, and then discharges the refrigerant, an indoor unit 120 installed in the room and having a heat exchanger therein, a compressor 130 which compresses lower pressure refrigerant under an adiabatic condition and discharges the refrigerant, and an outdoor unit 140 installed outside the room and having a heat exchanger therein. An inlet and an outlet of the compressor 130 are connected to a first compressor line 194 and a second compressor line 195, respectively. The first and second compressor lines 194 and 195 are provided with pressure gauges 197*a* and 197*b*, respectively, which detect a pressure of refrigerant introduced into the compressor 130 and a pressure of refrigerant discharged from the compressor 130, respectively. A thermometer (not shown) is mounted on an outer surface of the compressor 130 to measure an outside temperature of the compressor 130.

The expansion unit 110, the indoor unit 120, the compressor 130 and the outdoor unit 140 are connected to each other via lines and valves to form a refrigerant-circulating path for cooling and heating operations. More specifically, one end of a first refrigerant line 193 is connected to the portion of the first compressor line 194 positioned between the indoor unit 120 and the pressure gauge 197*a*, while the other end of the first refrigerant line 193 is connected to the portion of the second compressor line 195 positioned between the outdoor unit 140 and the pressure gauge 197*b*. One end of a second refrigerant line 196 is connected to the portion of the first compressor line 194 positioned between the indoor unit 120 and the pressure gauge 197*a*, while the other end of the second refrigerant line 196 is connected to the portion of the second compressor line 195 positioned between the outdoor unit 140 and the pressure gauge 197*b*. The first and second refrigerant lines 193 and 196 are provided with ON/OFF valves 193*a* and 196*a*, respectively, to permit or block flow of refrigerant therethrough. The first compressor line 194 and the second compressor line 195 are provided with ON/OFF valves 194*a* and 195*a*, respectively, which are positioned between the connecting ends of the first refrigerant line 193 and the connecting ends of the second refrigerant line 196, to permit or block flow of refrigerant therethrough.

The refrigeration system 100 according to the second embodiment includes a bypass line 199, which is connected at its one end to the portion of the second compressor line 195 positioned between the pressure gauge 197*b* and the second refrigerant line 196 and connected at the other end to the portion of the first compressor line 194 positioned between the pressure gauge 197*a* and the first refrigerant line 193, so as to direct a part or all of refrigerant discharged from the compressor 130 from the portion of the second compressor line 195 to the portion of the first compressor line 194, thereby enabling the refrigerant to be introduced into the compressor 130 again. The refrigerant bypass line 199 is provided with a bypass valve 199*a*, to permit or block flow of refrigerant therethrough, and to control a flow rate of the refrigerant, if required. The second compressor line 195 is provided with a flow control valve 199*b* between the refrigerant bypass line 199 and the second refrigerant line 196, to control a flow rate of refrigerant, and to permit or block flow of the refrigerant therethrough, if required. The refrigerant bypass line 199 further includes a check valve 199*c* to prevent refrigerant introduced into the compressor 130 from flowing back to the refrigerant bypass line 199.

The refrigeration system 100 further includes a first auxiliary evaporator 150, which is connected between the expansion unit 110 and the outdoor unit 140, and a second auxiliary evaporator 160, which is connected between the expansion unit 110 and the indoor unit 120. The first auxiliary evaporator 150 includes a housing 151 having a heat exchanger 152 therein, and the second auxiliary evaporator 160 includes a housing 161 having a heat exchanger 162 therein. The heat exchanger 152 serves as a refrigerant path connecting the expansion unit 110 to the outdoor unit 140, and the heat exchanger 162 serves as a refrigerant path connecting the expansion unit 110 to the indoor unit 120. The housings 151 and 161 are provided with refrigerant inlets 153*a* and 163*a* and refrigerant outlets 153*b* and 163*b*, respectively, so that refrigerant is introduced into the housing 151 and 161 through the refrigerant inlets 153*a* and 163*a*, flows in predetermined paths while contacting outer surfaces of the heat exchangers 152 and 162, and then discharged from the housings 151 and 161 through the refrigerant outlets 153*b* and 163*b*.

A first line 154 is connected between the expansion unit 110 and the first auxiliary evaporator 150, from which a first bypass line 155 is branched, and a second line 164 is connected between the expansion unit 110 and the second auxiliary evaporator 160, from which a second bypass line 165 is branched. The first and second bypass lines 155 and 165 are provided with flow control valves 155*a* and 165*a*, respectively, and connected to ends of first and second auxiliary expansion units 171 and 172, respectively. The other ends of the first and second auxiliary expansion units 171 and 172 are connected to the refrigerant inlets 153*a* and 163*a* of the first and second auxiliary evaporators 150 and 160, respectively.

The refrigerant outlets 153*b* and 163*b* of the first and second auxiliary evaporators 150 and 160 are connected to ends of first and second lower temperature-refrigerant outflow lines 156 and 166, respectively. The other ends of the first and second lower temperature-refrigerant outflow lines 156 and 166 are connected to an end of a lower temperature-refrigerant feeding line 191 together. The other end of the lower temperature-refrigerant feeding line 191 is connected to the portion of the first refrigerant line 193 positioned between the first compressor line 194 and the ON/OFF valve 193*a*. The first and second lower temperature-refrigerant outflow lines 156 and 166 are provided at predetermined positions thereof with ON/OFF valves 156*a* and 166*a*, respectively. The first refrigerant line 193 is provided with an ON/OFF valve 193*b* at a portion positioned between the lower temperature-refrigerant feeding line 191 and the first compressor line 194.

Figure 8:
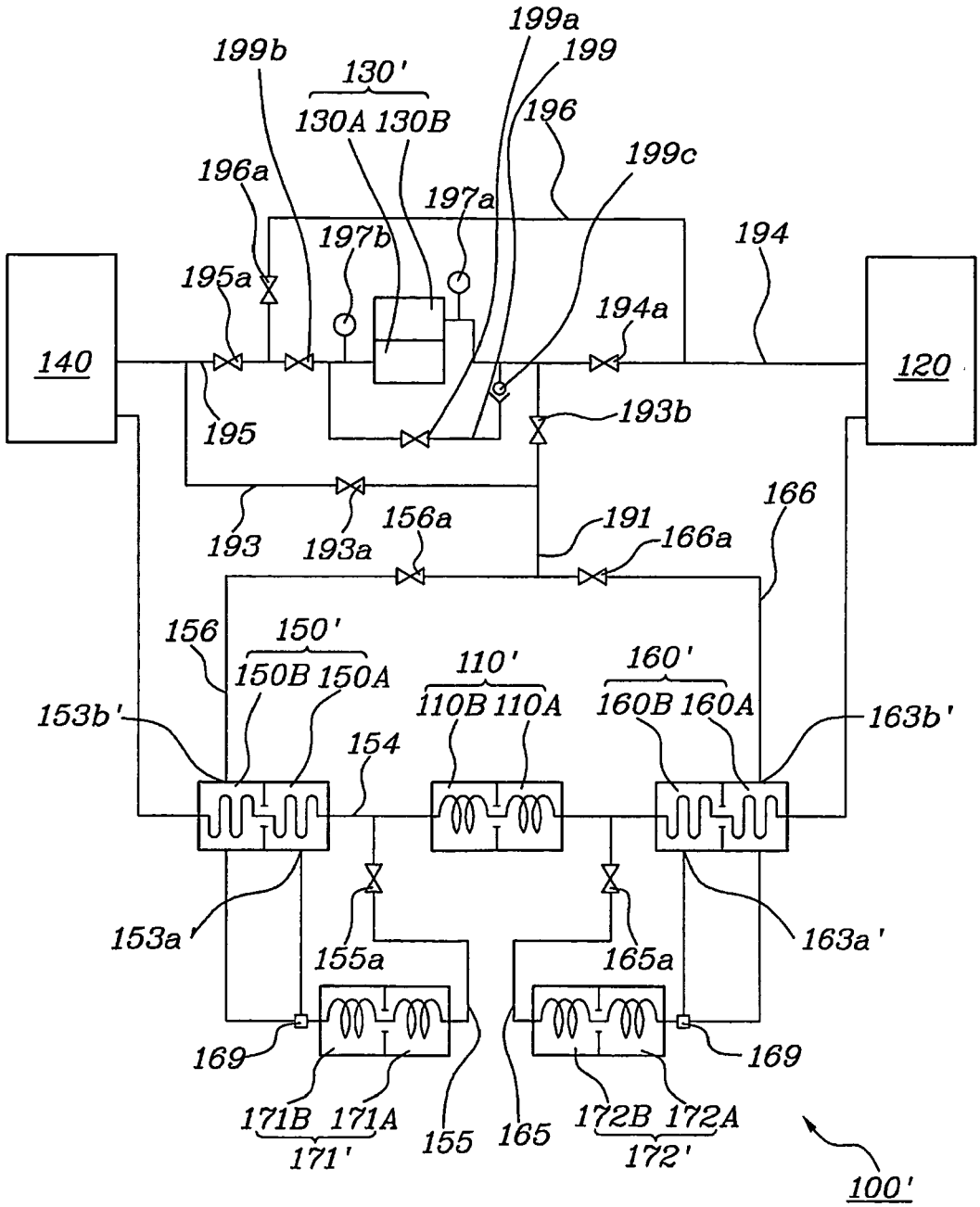
FIG. 8 is a circuit diagram showing a modification of the refrigeration system of FIG. 5.

FIG. 8 shows a modification of the second embodiment of the present invention shown in FIG. 5. In a description of the modification shown in FIG. 8, a description relating to the same parts as those of the embodiment shown in FIG. 5 is omitted, and only a description relating to parts different from those of the embodiment of FIG. 5 is disclosed herein.

In this modification, the expansion unit 110 of the second embodiment shown in FIG. 5 is substituted with an expansion complex 110' comprised of a plurality of expansion units 110A and 110B, which are arranged in series or in parallel with respect to the refrigerant path, and the compressor 130 of the second embodiment shown in FIG. 5 is substituted with a compressor complex 130' comprised of a plurality of compressors 130A and 130B, which are arranged in series or in parallel with respect to the refrigerant path. Furthermore, the first and second auxiliary evaporators 150 and 160 of the second embodiment are substituted with first and second auxiliary evaporator complexes 150' and 160', which are comprised a plurality of first and second auxiliary evaporators 150A, 150B and 160A, 160*b* arranged in series or in parallel with respect to the refrigerant path, respectively, and the first and second auxiliary expansion units 171 and 172 of the second embodiment are substituted with first and second auxiliary expansion complexes 171' and 172', which are comprised of a plurality of auxiliary expansion units 171A, 171B and 172A, 172B arranged in series or in parallel with respect to the refrigerant path, respectively.

Of the auxiliary evaporators 150A and 150B of the first auxiliary evaporator complex 150', the auxiliary evaporator 150B adjacent to the outdoor unit 140 is provided with a refrigerant outlet 153*b*', and the auxiliary evaporator 150A adjacent to the expansion complex 110' is provided with a refrigerant inlet 153*a*'. Of the auxiliary evaporators 160A and 160B of the second auxiliary evaporator complex 160', the auxiliary evaporator 160A adjacent to the indoor unit 120 is provided with a refrigerant outlet 163*b*', and the auxiliary evaporator 160B adjacent to the expansion complex 110' is provided with a refrigerant inlet 163*a*'. It is to be understood that the positions of the refrigerant inlets and the refrigerant outlets are not limited by any of the details of the above description, but rather are constructed broadly.

According to this modification, the refrigeration system 100' can increase expansion and compression capabilities with the aid of the component complexes comprised of a plurality of component units, and also can alleviate expansion and compression loads of the respective component units.

The first auxiliary expansion complex 171' is preferably provided at its refrigerant outflow side with a distributor 169, so that refrigerant is distributed to the respective first auxiliary evaporators 150A and 150B constituting the first auxiliary evaporator complex 150', or refrigerant is selectively distributed to the first auxiliary evaporators 150A or 150B, if required. In similar fashion, the second auxiliary expansion complex 172' is preferably provided at its refrigerant outflow side with a distributor 169, so that refrigerant is distributed to the respective second auxiliary evaporators 160A and 160B constituting the second auxiliary evaporator complex 160', or refrigerant is selectively distributed to the second auxiliary evaporators 160A or 160B, if required.

Accordingly, temperature of refrigerant, which is discharged from the first and second auxiliary evaporator complexes 150' and 160' and introduced into the expansion unit 110, can be changed according to a refrigerant path determined by an operation of the distributor 169, thereby enabling the refrigeration system 100' to be operated under various conditions.

Figure 9:
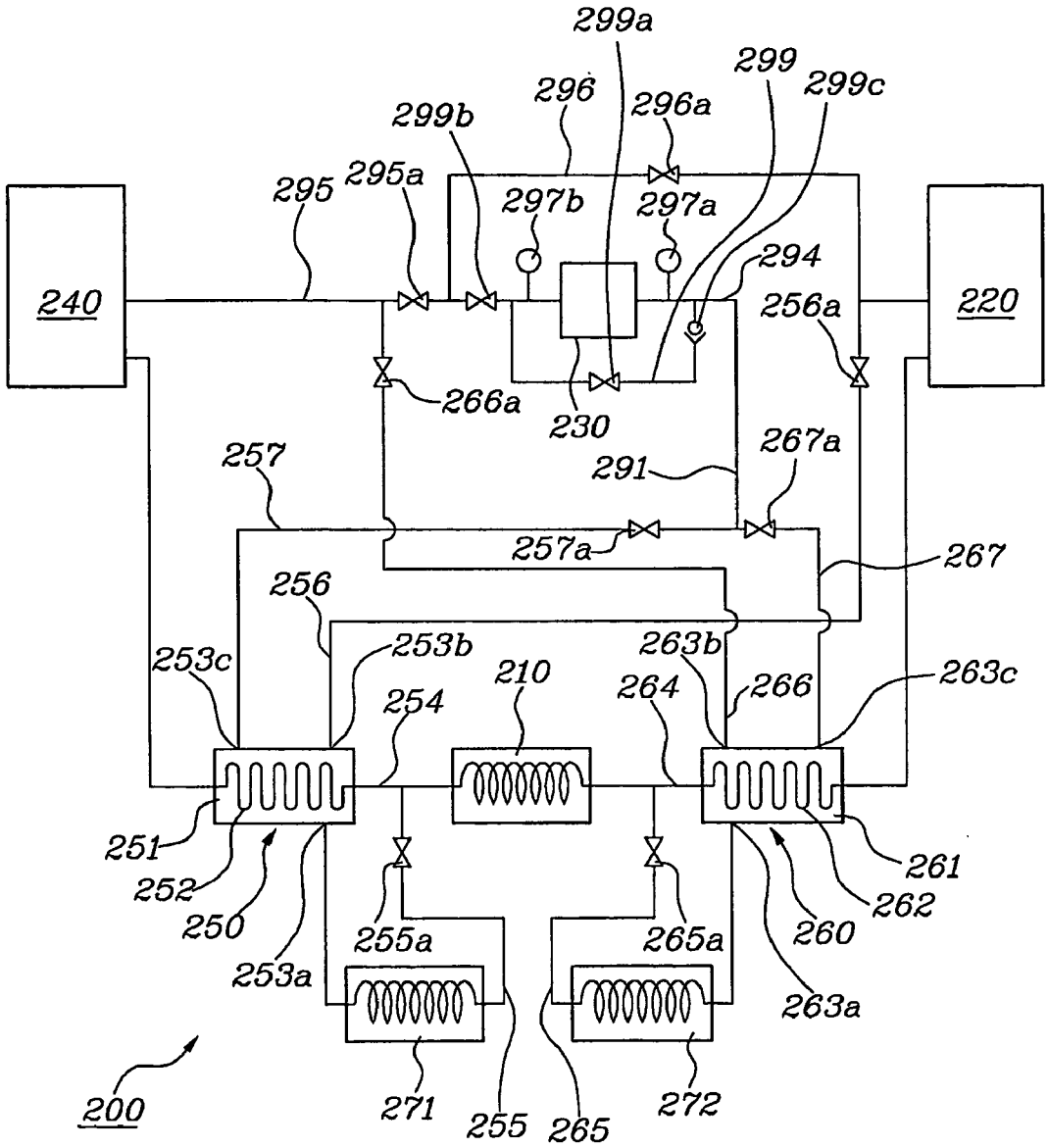
FIG. 9 is a circuit diagram showing a refrigeration system of an air conditioning apparatus with a bypass line connected between an inlet and an outlet of a compressor, according to a third embodiment of the present invention.

FIG. 9 shows a refrigeration system of an air conditioning apparatus with a bypass line connected between an inlet and an outlet of a compressor, according to a third embodiment of the present invention.

As shown in FIG. 9, the refrigeration system 200 according to the third embodiment includes an expansion unit 210, which allows refrigerant in a state of higher temperature and higher pressure, which is introduced thereinto, to be expanded under an adiabatic condition, resulting in refrigerant in a state of lower temperature and lower pressure, and then discharges the refrigerant, an indoor unit 220 installed in the room and having a heat exchanger therein, a compressor 230 which compresses lower pressure refrigerant under an adiabatic condition and discharges the refrigerant, and an outdoor unit 240 installed outside the room and having a heat exchanger therein. An inlet and an outlet of the compressor 230 are connected to a first compressor line 294 and a second compressor line 295, respectively. The first and second compressor lines 294 and 295 are provided with pressure gauges 297*a* and 297*b*, respectively, which detect a pressure of refrigerant introduced into the compressor 230 and a pressure of refrigerant discharged from the compressor 230, respectively. A thermometer (not shown) is mounted on an outer surface of the compressor 230 to measure an outside temperature of the compressor 230.

The refrigeration system 200 according to the third embodiment includes a refrigerant bypass line 299, which directs a part or all of refrigerant discharged from the compressor 230 back to the compressor 230, thereby enabling the refrigerant to be introduced into the compressor 230 again. The refrigerant bypass line 299 is provided with a bypass valve 299*a*, to permit or block flow of refrigerant therethrough, and to control a flow rate of the refrigerant, if required. The second compressor line 295 is provided with a flow control valve 299*b* to control a flow rate of refrigerant, and to permit or block flow of the refrigerant therethrough, if required. The refrigerant bypass line 299 further includes a check valve 299*c* to prevent refrigerant introduced into the compressor 230 from flowing back to the refrigerant bypass line 299.

The expansion unit 210, the indoor unit 220, the compressor 230 and the outdoor unit 240 are connected to each other via lines and valves to form a refrigerant-circulating path for cooling and heating operations. A first auxiliary evaporator 250 is connected between the expansion unit 210 and the outdoor unit 240, and a second auxiliary evaporator 260 is connected between the expansion unit 210 and the indoor unit 220. The first auxiliary evaporator 250 includes a housing 251 having a heat exchanger 252 therein, and the second auxiliary evaporator 260 includes a housing 261 having a heat exchanger 262 therein. The heat exchanger 252 serves as a refrigerant path connecting the expansion unit 210 to the outdoor unit 240, and the heat exchanger 262 serves as a refrigerant path connecting the expansion unit 210 to the indoor unit 220. The housings 251 and 261 are provided with a plurality of refrigerant inlets 253*a*, 253*b* and 263*a*, 263*b* and refrigerant outlets 253*c* and 263*c*, respectively, so that refrigerant is introduced into the housing 251 and 261 through the refrigerant inlets 253*a*, 253*b* and 263*a*, 263*b*, flows in predetermined paths while contacting outer surfaces of the heat exchangers 252 and 262, and then discharged from the housings 251 and 261 through the refrigerant outlets 253*c* and 263*c*.

A first line 254 is connected between the expansion unit 210 and the first auxiliary evaporator 250, from which a first bypass line 255 is branched, and a second line 264 is connected between the expansion unit 210 and the second auxiliary evaporator 260, from which a second bypass line 265 is branched. The first and second bypass lines 255 and 265 are provided with flow control valves 255*a* and 265*a*, respectively, and connected to ends of first and second auxiliary expansion units 271 and 272, respectively. The other ends of the first and second auxiliary expansion units 271 and 272 are connected to the refrigerant inlets 253*a* and 263*a* of the first and second auxiliary evaporators 250 and 260, respectively.

The other refrigerant inlets 253*b* and 263*b* of the first and second auxiliary evaporators 250 and 260 are connected to ends of first and second higher temperature-refrigerant inflow lines 256 and 266. The other end of the first higher temperature-refrigerant inflow line 256 is connected to the indoor unit 220, and the other end of the second higher temperature-refrigerant inflow line 266 is connected to a predetermined portion of the second compressor line 295 connected between the refrigerant outlet of the compressor 230 and the outdoor unit 240, i.e. the portion of the second compressor line 295 positioned between the outdoor unit 240 and the refrigerant bypass line 299.

The refrigerant outlets 253*c* and 263*c* of the first and second auxiliary evaporators 250 and 260 are connected to ends of first and second lower temperature-refrigerant outflow lines 257 and 267, respectively. The other ends of the first and second lower temperature-refrigerant outflow lines 257 and 267 are connected to an end of a lower temperature-refrigerant feeding line 291 together. The other end of the lower temperature-refrigerant feeding line 291 is connected to the first compressor line 294.

The first and second higher temperature-refrigerant inflow lines 256 and 266 and the first and second lower temperature-refrigerant outflow lines 257 and 267 are provided with ON/OFF valves 256*a*, 266*a*, 257*a* and 267*a*, respectively.

The second compressor line 295 is provided with an ON/OFF valve 295*a* between the second higher temperature-refrigerant inflow line 266 and the compressor 230. A refrigerant line 296 is branched from the second compressor line 295 between the ON/OFF valve 295*a* and the flow control valve 299*b*. The refrigerant line 296 is connected to the first higher temperature-refrigerant inflow line 256 between the ON/OFF valve 256*a* and the indoor unit 220.

Figure 12:
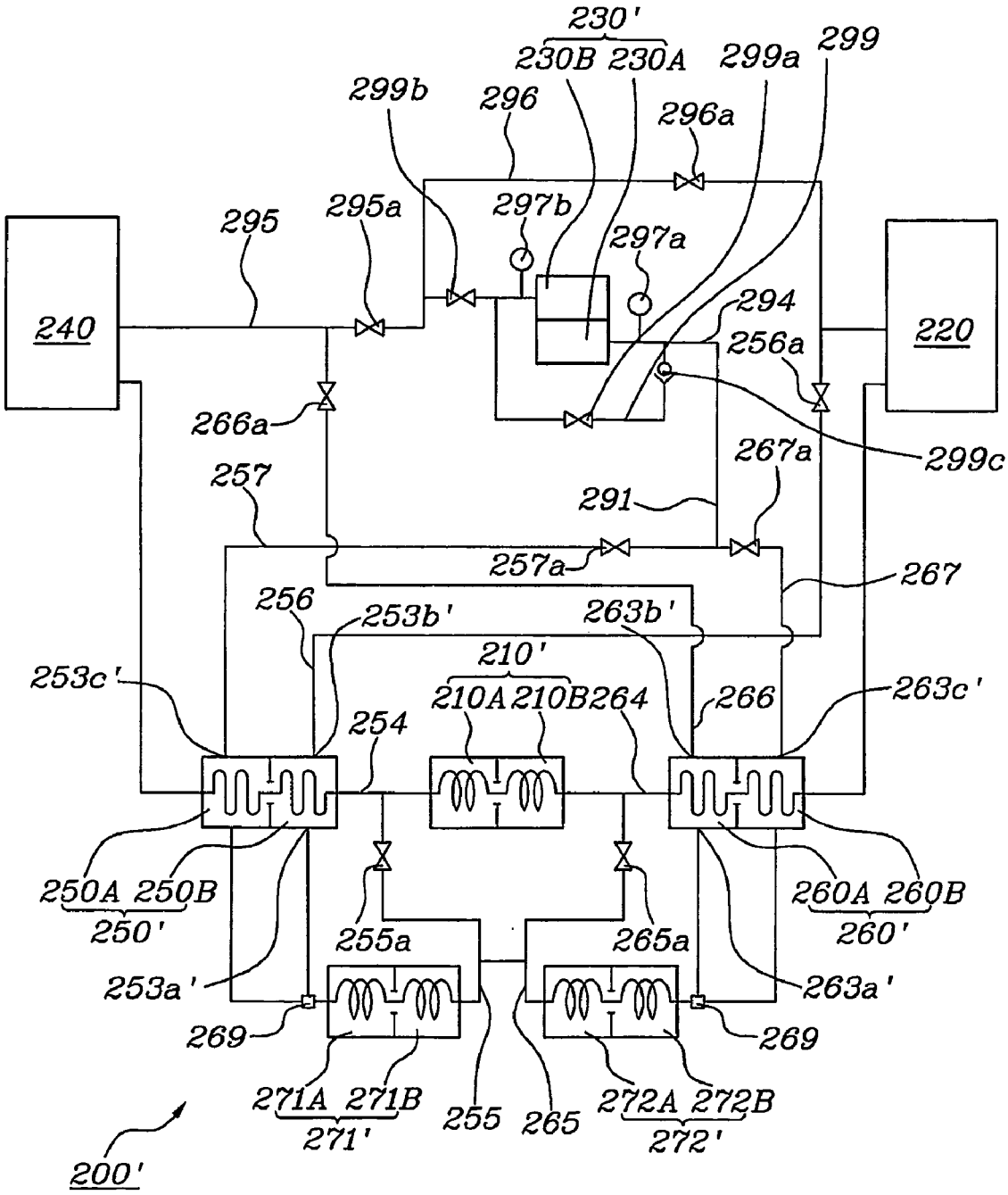
FIG. 12 is a circuit diagram showing a modification of the refrigeration system of FIG. 9.

FIG. 12 shows a modification of the third embodiment of the present invention shown in FIG. 9. In a description of the modification shown in FIG. 12, a description relating to the same parts as those of the embodiment shown in FIG. 9 is omitted, and only a description relating to parts different from those of the embodiment of FIG. 9 is disclosed herein.

In this modification, the expansion unit 210 of the third embodiment shown in FIG. 9 is substituted with an expansion complex 210' comprised of a plurality of expansion units 210A and 210B, which are arranged in series or in parallel with respect to the refrigerant path, and the compressor 230 of the third embodiment shown in FIG. 9 is substituted with a compressor complex 230' comprised of a plurality of compressors 230A and 230B, which are arranged in series or in parallel with respect to the refrigerant path. Furthermore, the first and second auxiliary evaporators 250 and 260 of the third embodiment are substituted with first and second auxiliary evaporator complexes 250' and 260', which are comprised a plurality of first and second auxiliary evaporators 250A, 250B and 260A, 260*b* arranged in series or in parallel with respect to the refrigerant path, respectively, and the first and second auxiliary expansion units 271 and 272 of the third embodiment are substituted with first and second auxiliary expansion complexes 271' and 272', which are comprised of a plurality of auxiliary expansion units 271A, 271B and 272A, 272B arranged in series or in parallel with respect to the refrigerant path, respectively.

Of the auxiliary evaporators 250A and 250B of the first auxiliary evaporator complex 250', the auxiliary evaporator 250B adjacent to the outdoor unit 240 is provided with a refrigerant outlet 253*b*', and the auxiliary evaporator 250A adjacent to the expansion complex 210' is provided with refrigerant inlets 253*a*' and 253*b*'. Of the auxiliary evaporators 260A and 260B of the second auxiliary evaporator complex 260', the auxiliary evaporator 260A adjacent to the indoor unit 220 is provided with a refrigerant outlet 263*b*', and the auxiliary evaporator 260B adjacent to the expansion complex 210' is provided with refrigerant inlets 263*a*' and 263*b*'. It is to be understood that the positions of the refrigerant inlets and the refrigerant outlets are not limited by any of the details of the above description, but rather are constructed broadly.

According to this modification, the refrigeration system 200' can increase expansion and compression capabilities with the aid of the component complexes comprised of a plurality of component units, and also can alleviate expansion and compression loads of the respective component units.

The first auxiliary expansion complex 271' is preferably provided at its refrigerant outflow side with a distributor 269, so that refrigerant is distributed to the respective first auxiliary evaporators 250A and 250B constituting the first auxiliary evaporator complex 250', or refrigerant is selectively distributed to the first auxiliary evaporators 250A or 250B, if required. In similar fashion, the second auxiliary expansion complex 272' is preferably provided at its refrigerant outflow side with a distributor 269, so that refrigerant is distributed to the respective second auxiliary evaporators 260A and 260B constituting the second auxiliary evaporator complex 260', or refrigerant is selectively distributed to the second auxiliary evaporators 260A or 260B, if required.

Accordingly, temperature of refrigerant, which is discharged from the first and second auxiliary evaporator complexes 250' and 260' and introduced into the expansion unit 210, can be changed according to a refrigerant path determined by an operation of the distributor 269, thereby enabling the refrigeration system 200' to be operated under various conditions.

Figure 13:
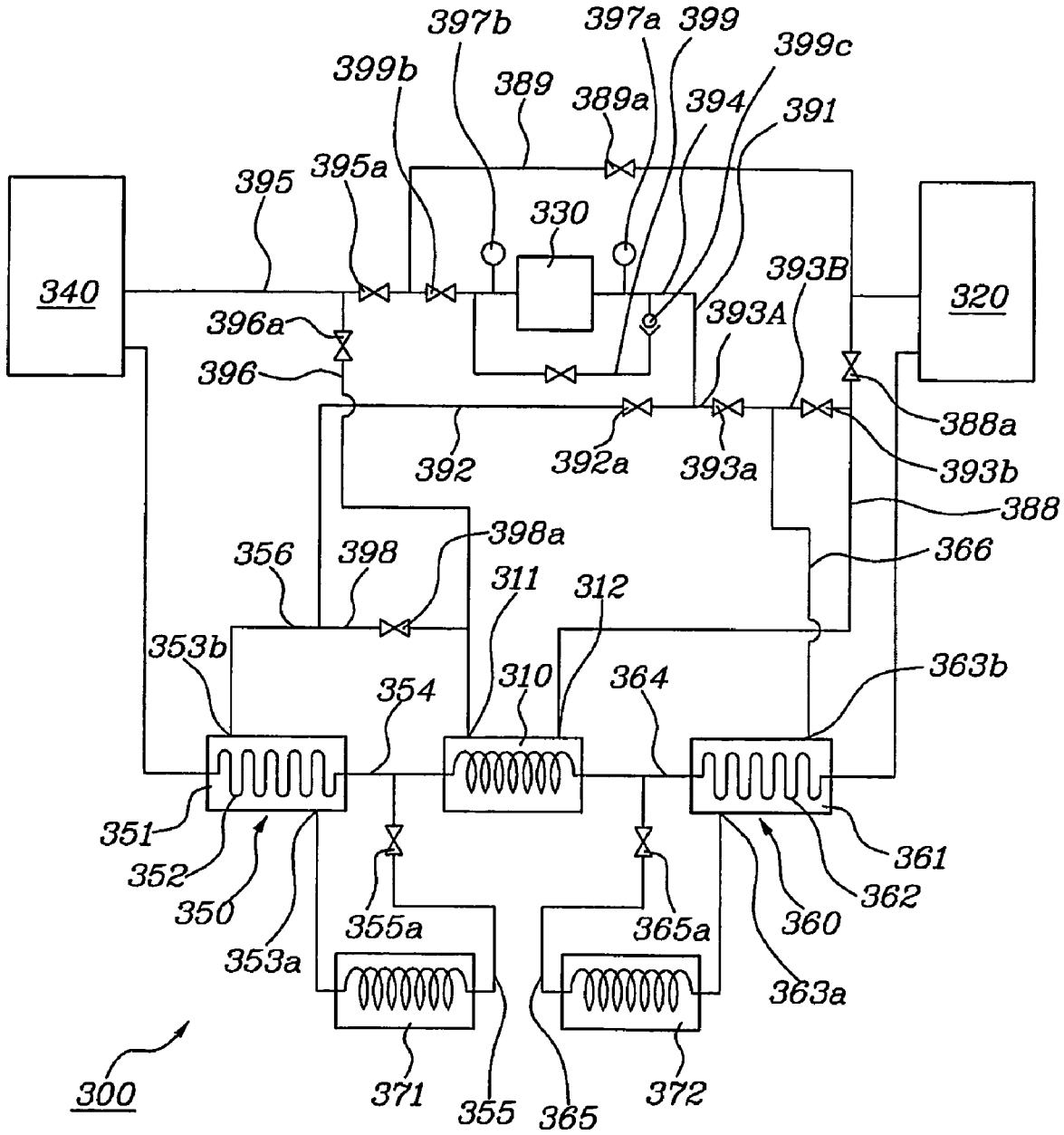
FIG. 13 is a circuit diagram showing a refrigeration system of an air conditioning apparatus with a bypass line connected between an inlet and an outlet of a compressor, according to a fourth embodiment of the present invention.

FIG. 13 shows a refrigeration system of an air conditioning apparatus with a bypass line connected between an inlet and an outlet of a compressor, according to a fourth embodiment of the present invention.

As shown in FIG. 13, the refrigeration system 300 according to the fourth embodiment includes an expansion unit 310, which allows refrigerant in a state of higher temperature and higher pressure, which is introduced thereinto, to be expanded under an adiabatic condition, resulting in refrigerant in a state of lower temperature and lower pressure, and then discharges the refrigerant, an indoor unit 320 installed in the room and having a heat exchanger therein, a compressor 330 which compresses lower pressure refrigerant under an adiabatic condition and discharges the refrigerant, and an outdoor unit 340 installed outside the room and having a heat exchanger therein. An inlet and an outlet of the compressor 330 are connected to a first compressor line 394 and a second compressor line 395, respectively. The first and second compressor lines 394 and 395 are provided with pressure gauges 397*a* and 397*b*, respectively, which detect a pressure of refrigerant introduced into the compressor 330 and a pressure of refrigerant discharged from the compressor 330, respectively. A thermometer (not shown) is mounted on an outer surface of the compressor 330 to measure an outside temperature of the compressor 230.

The refrigeration system 300 according to the fourth embodiment includes a bypass line 399, which directs a part or all of refrigerant discharged from the compressor 330 back to the compressor 330, thereby enabling the refrigerant to be introduced into the compressor 330 again. The refrigerant bypass line 399 is provided with a bypass valve 399*a*, to permit or block flow of refrigerant therethrough, and to control a flow rate of the refrigerant, if required. The second compressor line 395 is provided with a flow control valve 399*b* to control a flow rate of refrigerant, and to permit or block flow of the refrigerant therethrough, if required. The refrigerant bypass line 399 further includes a check valve 399*c* to prevent refrigerant introduced into the compressor 330 from flowing back to the refrigerant bypass line 399.

The expansion unit 310, the indoor unit 320, the compressor 330 and the outdoor unit 340 are connected to each other via lines and valves to form a refrigerant-circulating path for cooling and heating operations. A first auxiliary evaporator 350 is connected between the expansion unit 310 and the outdoor unit 340, and a second auxiliary evaporator 360 is connected between the expansion unit 310 and the indoor unit 320. The first auxiliary evaporator 350 includes a housing 351 having a heat exchanger 352 therein, and the second auxiliary evaporator 360 includes a housing 361 having a heat exchanger 362 therein. The heat exchanger 352 serves as a refrigerant path connecting the expansion unit 310 to the outdoor unit 340, and the heat exchanger 362 serves as a refrigerant path connecting the expansion unit 310 to the indoor unit 320. The housings 351 and 361 are provided with refrigerant inlets 353*a* and 363*a* and refrigerant outlets 353*b* and 363*b*, respectively, so that refrigerant is introduced into the housing 351 and 361 through the refrigerant inlets 353*a* and 363*a*, flows in predetermined paths while contacting outer surfaces of the heat exchangers 352 and 362, and then discharged from the housings 351 and 361 through the refrigerant outlets 353*b* and 363*b*.

A first line 354 is connected between the expansion unit 310 and the first auxiliary evaporator 350, from which a first bypass line 355 is branched, and a second line 364 is connected between the expansion unit 310 and the second auxiliary evaporator 360, from which a second bypass line 365 is branched. The first and second bypass lines 355 and 365 are provided with flow control valves 355*a* and 365*a*, respectively, and connected to ends of first and second auxiliary expansion units 371 and 372, respectively. The other ends of the first and second auxiliary expansion units 371 and 372 are connected to the refrigerant inlets 353*a* and 363*a* of the first and second auxiliary evaporators 350 and 360, respectively.

The other refrigerant inlets 353*b* and 363*b* of the first and second auxiliary evaporators 350 and 360 are connected to ends of first and second lower temperature-refrigerant outflow lines 356 and 366. The other ends of the first and second lower temperature-refrigerant outflow lines 356 and 366 are connected to an end of a lower temperature-refrigerant feeding line 391 via first and second connecting lines 392 and 393A. The other end of the lower temperature-refrigerant feeding line 391 is connected to a refrigerant inlet of the compressor 330 via the first compressor line 394. The first and second refrigerant lines 392 and 393A are provided with ON/OFF valves 392*a* and 393*a*, respectively.

The second compressor line 395 is provided with an ON/OFF valve 395*a* between the outdoor unit 340 and the flow control valve 399*b*. Third and fourth connecting lines 396 and 389 are branched from both ends of the ON/OFF valve 395*a* of the second compressor line 395. The third connecting line 396 adjacent to the outdoor unit 340 is provided with an ON/OFF valve 396*a*, and connected to a first refrigerant inlet/outlet 311 of the expansion unit 310. The connecting line 389 adjacent to the compressor 330 is provided with an ON/OFF valve 380*a*, and connected to the outdoor unit 320.

A fifth connecting line 398 is branched from the third connecting line 396 between the ON/OFF valve 396*a* and the expansion unit 310. The fifth connecting line 398 is provided with an ON/OFF valve 398*a*, and connected to a conjunction point between the first lower temperature-refrigerant outflow line 356 and the first connecting line 392. A sixth connecting line 388 is branched from the fourth connecting line 389 between the ON/OFF valve 380*a* and the indoor unit 320. The sixth connecting line 388 is provided with an ON/OFF valve 388*a*, and connected to a second refrigerant inlet/outlet 312 of the expansion unit 310. A seventh connecting line 393B is branched from the sixth connecting line 388 between the ON/OFF valve 388*a* and the expansion unit 310. The seventh connecting line 393B is provided with an ON/OFF valve 303*b*, and connected to a conjunction point between the second lower temperature-refrigerant outflow line 366 and the second connecting line 393A.

Figure 16:
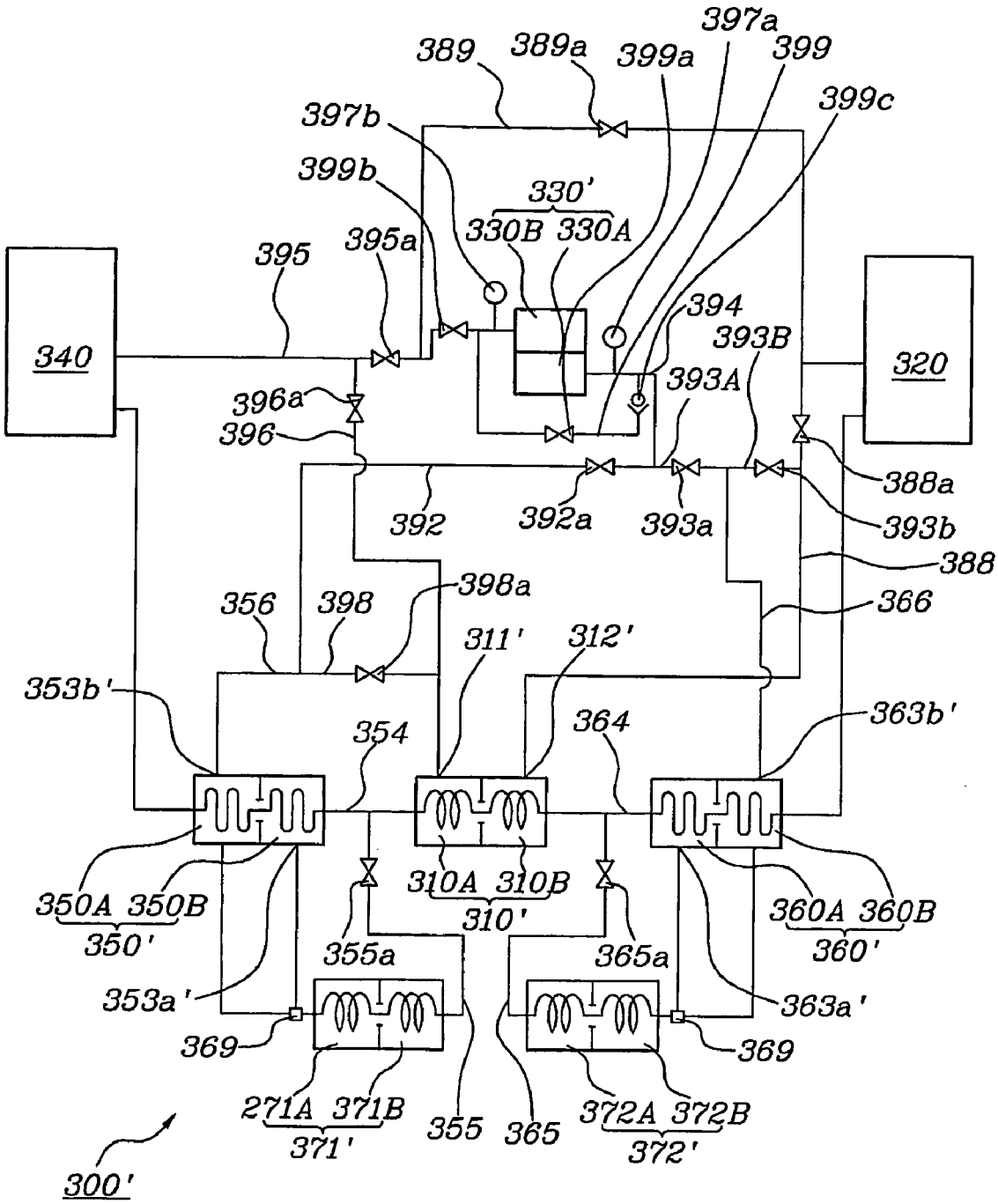
FIG. 16 is a circuit diagram showing a modification of the refrigeration system of FIG. 13.

FIG. 16 shows a modification of the fourth embodiment of the present invention shown in FIG. 13. In a description of the modification shown in FIG. 16, a description relating to the same parts as those of the embodiment shown in FIG. 13 is omitted, and only a description relating to parts different from those of the embodiment of FIG. 13 is disclosed herein.

In this modification, the expansion unit 310 of the fourth embodiment shown in FIG. 13 is substituted with an expansion complex 310' comprised of a plurality of expansion units 310A and 310B, which are arranged in series or in parallel with respect to the refrigerant path, and the compressor 330 of the fourth embodiment shown in FIG. 13 is substituted with a compressor complex 330' comprised of a plurality of compressors 330A and 330B, which are arranged in series or in parallel with respect to the refrigerant path. Furthermore, the first and second auxiliary evaporators 350 and 360 of the fourth embodiment are substituted with first and second auxiliary evaporator complexes 350' and 360', which are comprised a plurality of first and second auxiliary evaporators 350A, 350B and 360A, 360B arranged in series or in parallel with respect to the refrigerant path, respectively, and the first and second auxiliary expansion units 371 and 372 of the fourth embodiment are substituted with first and second auxiliary expansion complexes 371' and 372', which are comprised of a plurality of auxiliary expansion units 371A, 371B and 372A, 372B arranged in series or in parallel with respect to the refrigerant path, respectively.

Of the auxiliary evaporators 350A and 350B of the first auxiliary evaporator complex 350', the auxiliary evaporator 350B adjacent to the outdoor unit 340 is provided with a refrigerant outlet 353*b*', and the auxiliary evaporator 350A adjacent to the expansion complex 310' is provided with a refrigerant inlet 353*a*'. Of the auxiliary evaporators 360A and 360B of the second auxiliary evaporator complex 360', the auxiliary evaporator 360A adjacent to the indoor unit 320 is provided with a refrigerant outlet 363*b*', and the auxiliary evaporator 360B adjacent to the expansion complex 310' is provided with a refrigerant inlet 363*a*'. Of the expansion units 310A and 310B of the expansion complex 310', the expansion unit 310A adjacent to the first auxiliary evaporator complex 350' is provided with a first refrigerant inlet/outlet 311', and the expansion unit 310B adjacent to the second auxiliary evaporator complex 360' is provided with a second refrigerant inlet/outlet 312'. It is to be understood that the positions of the refrigerant inlets, the refrigerant outlets and the refrigerant inlet/outlets are not limited by any of the details of the above description, but rather are constructed broadly.

According to this modification, the refrigeration system 300' can increase expansion and compression capabilities with the aid of the component complexes comprised of a plurality of component units, and also can alleviate expansion and compression loads of the respective component units.

The first auxiliary expansion complex 371' is preferably provided at its refrigerant outflow side with a distributor 369, so that refrigerant is distributed to the respective first auxiliary evaporators 350A and 350B constituting the first auxiliary evaporator complex 350', or refrigerant is selectively distributed to the first auxiliary evaporators 350A or 350B, if required. In similar fashion, the second auxiliary expansion complex 372' is preferably provided at its refrigerant outflow side with a distributor 369, so that refrigerant is distributed to the respective second auxiliary evaporators 360A and 360B constituting the second auxiliary evaporator complex 360', or refrigerant is selectively distributed to the second auxiliary evaporators 360A or 360B, if required.

Accordingly, temperature of refrigerant, which is discharged from the first and second auxiliary evaporator complexes 350' and 360' and introduced into the expansion unit 310, can be changed according to a refrigerant path determined by an operation of the distributor 369, thereby enabling the refrigeration system 300' to be operated under various conditions.

Figure 17:
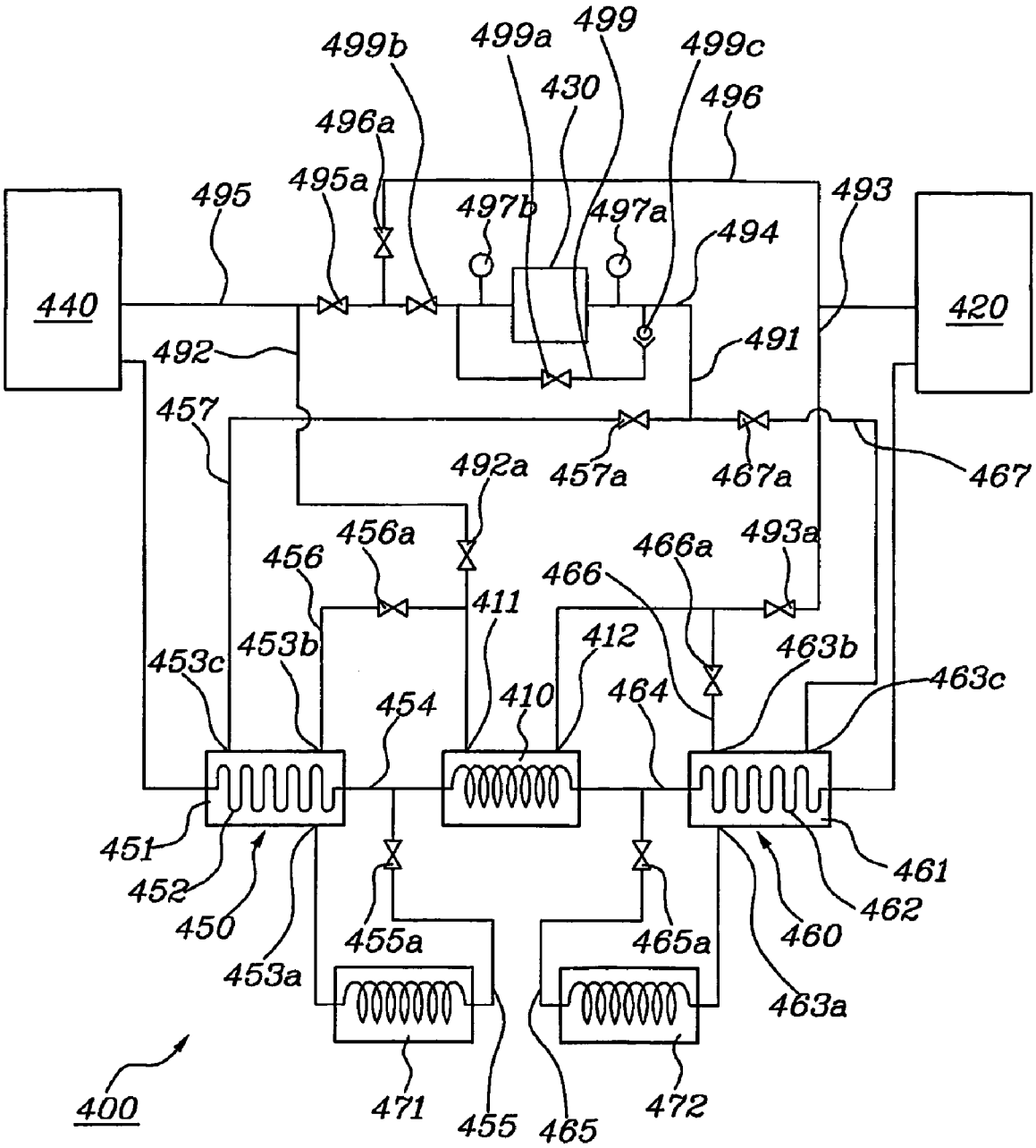
FIG. 17 is a circuit diagram showing a refrigeration system of an air conditioning apparatus with a bypass line connected between an inlet and an outlet of a compressor, according to a fifth embodiment of the present invention.

FIG. 17 shows a refrigeration system of an air conditioning apparatus with a bypass line connected between an inlet and an outlet of a compressor, according to a fifth embodiment of the present invention.

As shown in FIG. 17, the refrigeration system 400 according to the fifth embodiment includes an expansion unit 410, which allows refrigerant in a state of higher temperature and higher pressure, which is introduced thereinto, to be expanded under an adiabatic condition, resulting in refrigerant in a state of lower temperature and lower pressure, and then discharges the refrigerant, an indoor unit 420 installed in the room and having a heat exchanger therein, a compressor 430 which compresses lower pressure refrigerant under an adiabatic condition and discharges the refrigerant, and an outdoor unit 440 installed outside the room and having a heat exchanger therein. An inlet and an outlet of the compressor 430 are connected to a first compressor line 494 and a second compressor line 495, respectively. The first and second compressor lines 494 and 495 are provided with pressure gauges 497*a* and 497*b*, respectively, which detect a pressure of refrigerant introduced into the compressor 430 and a pressure of refrigerant discharged from the compressor 430, respectively. A thermometer (not shown) is mounted on an outer surface of the compressor 430 to measure an outside temperature of the compressor 430.

The refrigeration system 400 according to the fifth embodiment includes a bypass line 499, which directs a part or all of refrigerant discharged from the compressor 430 back to the compressor 430, thereby enabling the refrigerant to be introduced into the compressor 430 again. The refrigerant bypass line 499 is provided with a bypass valve 499*a*, to permit or block flow of refrigerant therethrough, and to control a flow rate of the refrigerant, if required. The second compressor line 495 is provided with a flow control valve 499*b* to control a flow rate of refrigerant, and to permit or block flow of the refrigerant therethrough, if required. The refrigerant bypass line 499 further includes a check valve 499*c* to prevent refrigerant introduced into the compressor 430 from flowing back to the refrigerant bypass line 499.

The expansion unit 410, the indoor unit 420, the compressor 430 and the outdoor unit 440 are connected to each other via lines and valves to form a refrigerant-circulating path for cooling and heating operations. A first auxiliary evaporator 450 is connected between the expansion unit 410 and the outdoor unit 440, and a second auxiliary evaporator 460 is connected between the expansion unit 410 and the indoor unit 420. The first auxiliary evaporator 450 includes a housing 451 having a heat exchanger 452 therein, and the second auxiliary evaporator 460 includes a housing 461 having a heat exchanger 462 therein. The heat exchanger 452 serves as a refrigerant path connecting the expansion unit 410 to the outdoor unit 440, and the heat exchanger 462 serves as a refrigerant path connecting the expansion unit 410 to the indoor unit 420. The housings 451 and 461 are provided with a plurality of refrigerant inlets 453*a*, 453*b* and 463*a*, 463*b* and refrigerant outlets 453*c* and 463*c*, respectively, so that refrigerant is introduced into the housing 451 and 461 through the refrigerant inlets 453*a*, 453*b* and 463*a*, 463*b*, flows in predetermined paths while contacting outer surfaces of the heat exchangers 452 and 462, and then discharged from the housings 451 and 461 through the refrigerant outlets 453*c* and 463*c*.

A first line 454 is connected between the expansion unit 410 and the first auxiliary evaporator 450, from which a first bypass line 455 is branched, and a second line 464 is connected between the expansion unit 410 and the second auxiliary evaporator 460, from which a second bypass line 465 is branched. The first and second bypass lines 455 and 465 are provided with flow control valves 455*a* and 465*a*, respectively, and connected to ends of first and second auxiliary expansion units 471 and 472, respectively. The other ends of the first and second auxiliary expansion units 471 and 472 are connected to the refrigerant inlets 453*a* and 463*a* of the first and second auxiliary evaporators 450 and 460, respectively.

The other refrigerant inlets 453*b* and 463*b* of the first and second auxiliary evaporators 450 and 460 are connected to ends of first and second higher temperature-refrigerant inflow lines 456 and 466. The refrigerant outlets 453*c* and 463*c* are connected to an end of a lower temperature-refrigerant feeding line 491 via first and second lower temperature-refrigerant outflow lines 457 and 467. The other end of the lower temperature-refrigerant feeding line 491 is connected to a refrigerant inlet of the compressor 430 via the first compressor line 494.

The first and second higher temperature-refrigerant inflow lines 456 and 466 and the first and second lower temperature-refrigerant outflow lines 457 and 467 are provided with ON/OFF valves 456*a*, 466*a* and 457*a*, 467*a*, respectively.

The other end of the first higher temperature-refrigerant inflow line 456 is connected to a predetermined position of the first connecting line 492. The first connecting line 492 is connected at its one end to a first refrigerant inlet/outlet 411 of the expansion unit 410, and is connected at the other end to a predetermined position of the second compressor line 495 adjacent to a refrigerant-discharging side of the compressor 430. The first connecting line 492 is provided with an ON/OFF valve 492*a* between the first higher temperature-refrigerant inflow line 456 and the second compressor line 495.

The second higher temperature-refrigerant inflow line 466 is connected to a predetermined position of a second connecting line 493. The second connecting line 493 is connected at its one end to a second refrigerant inlet/outlet 412 of the expansion unit 410, and is connected at the other end to the indoor unit 420. The second connecting line 493 is provided with an ON/OFF valve 493*a* between the second higher temperature-refrigerant inflow line 466 and the indoor unit 420.

The second compressor line 495 is provided with an ON/OFF valve 495*a* between the first connecting line 492 and the flow control valve 499*b*. The second connecting line 493 and the second compressor line 495 are connected to each other via a third connecting line 496. The third connecting line 496 is connected at its one end to a conjunction point between the ON/OFF valve 493*a* of the second connecting line 493 and the indoor unit 420, and is connected at the other end to a conjunction point between the ON/OFF valve 495*a* and the flow control valve 499*b*. The third connecting line 496 is provided with an ON/OFF valve 496*a*.

Figure 20:
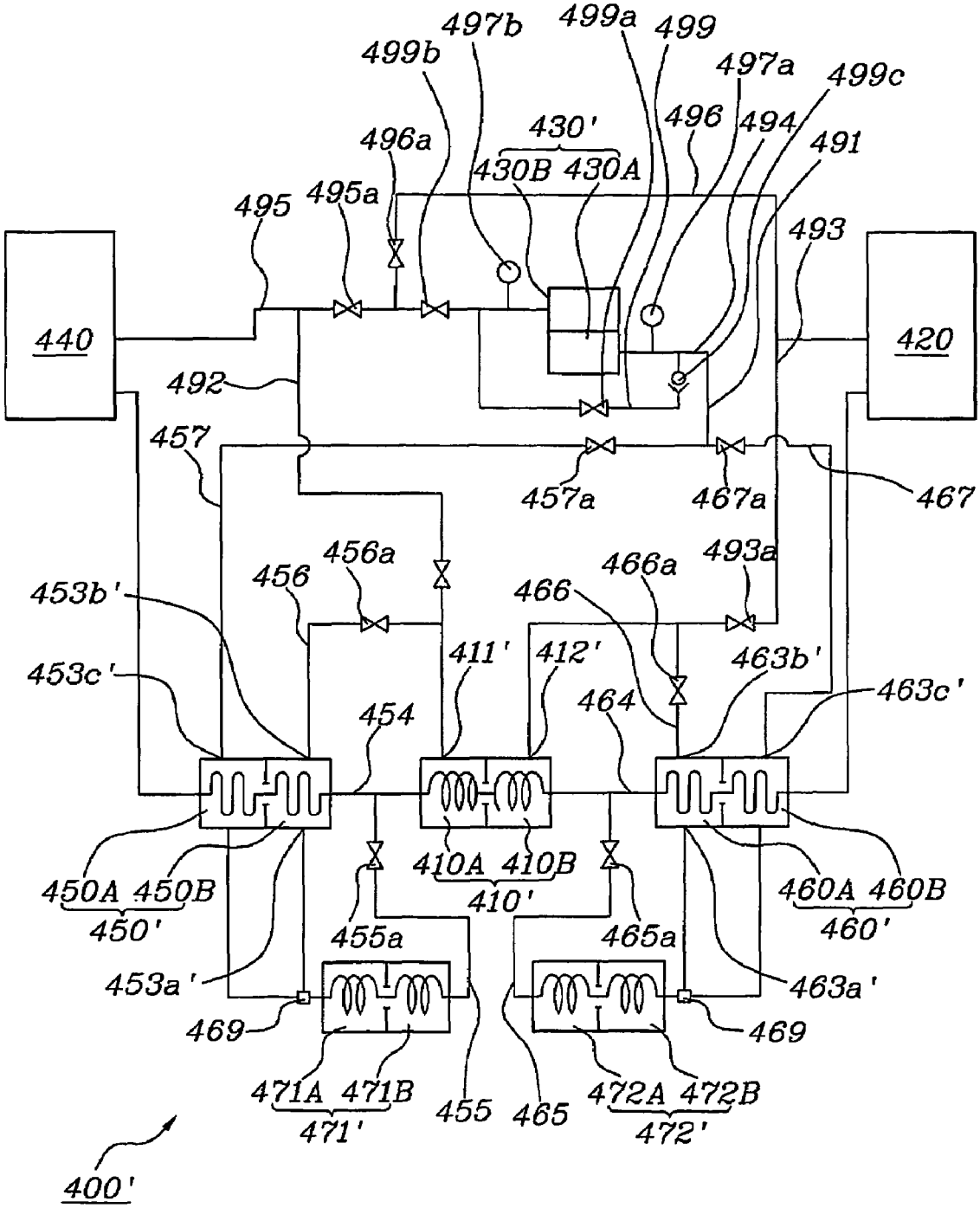
FIG. 20 is a circuit diagram showing a modification of the refrigeration system of FIG. 17.

FIG. 20 shows a modification of the fifth embodiment of the present invention shown in FIG. 17. In a description of the modification shown in FIG. 20, a description relating to the same parts as those of the embodiment shown in FIG. 17 is omitted, and only a description relating to parts different from those of the embodiment of FIG. 17 is disclosed herein.

In this modification, the expansion unit 410 of the fifth embodiment shown in FIG. 17 is substituted with an expansion complex 410' comprised of a plurality of expansion units 410A and 410B, which are arranged in series or in parallel with respect to the refrigerant path, and the compressor 430 of the fifth embodiment shown in FIG. 17 is substituted with a compressor complex 430' comprised of a plurality of compressors 430A and 430B, which are arranged in series or in parallel with respect to the refrigerant path. Furthermore, the first and second auxiliary evaporators 450 and 460 of the fifth embodiment are substituted with first and second auxiliary evaporator complexes 450' and 460', which are comprised a plurality of first and second auxiliary evaporators 450A, 450B and 460A, 460B arranged in series or in parallel with respect to the refrigerant path, respectively, and the first and second auxiliary expansion units 471 and 472 of the fifth embodiment are substituted with first and second auxiliary expansion complexes 471' and 472', which are comprised of a plurality of auxiliary expansion units 471A, 471B and 472A, 472B arranged in series or in parallel with respect to the refrigerant path, respectively.

Of the auxiliary evaporators 450A and 450B of the first auxiliary evaporator complex 450', the auxiliary evaporator 450B adjacent to the outdoor unit 440 is provided with a refrigerant outlet 453*b*', and the auxiliary evaporator 450A adjacent to the expansion complex 410' is provided with refrigerant inlets 453*a*' and 453*b*'. Of the auxiliary evaporators 460A and 460B of the second auxiliary evaporator complex 460', the auxiliary evaporator 460A adjacent to the indoor unit 420 is provided with a refrigerant outlet 463*c*', and the auxiliary evaporator 460B adjacent to the expansion complex 410' is provided with refrigerant inlets 463*a*' and 463*b*. Of the expansion units 410A and 4101B of the expansion complex 410', the expansion unit 410A adjacent to the first auxiliary evaporator complex 450' is provided with a first refrigerant inlet/outlet 411', and the expansion unit 410B adjacent to the second auxiliary evaporator complex 460' is provided with a second refrigerant inlet/outlet 412'. It is to be understood that the positions of the refrigerant inlets, the refrigerant outlets and the refrigerant inlet/outlets are not limited by any of the details of the above description, but rather are constructed broadly.

According to this modification, the refrigeration system 400' can increase expansion and compression capabilities with the aid of the component complexes comprised of a plurality of component units, and also can alleviate expansion and compression loads of the respective component units.

The first auxiliary expansion complex 471' is preferably provided at its refrigerant outflow side with a distributor 469, so that refrigerant is distributed to the respective first auxiliary evaporators 450A and 450B constituting the first auxiliary evaporator complex 450', or refrigerant is selectively distributed to the first auxiliary evaporators 450A or 450B, if required. In similar fashion, the second auxiliary expansion complex 472' is preferably provided at its refrigerant outflow side with a distributor 469, so that refrigerant is distributed to the respective second auxiliary evaporators 460A and 460B constituting the second auxiliary evaporator complex 460', or refrigerant is selectively distributed to the second auxiliary evaporators 460A or 460B, if required.

Accordingly, temperature of refrigerant, which is discharged from the first and second auxiliary evaporator complexes 450' and 460' and introduced into the expansion unit 410, can be changed according to a refrigerant path determined by an operation of the distributor 469, thereby enabling the refrigeration system 400' to be operated under various conditions.

The refrigeration system according to the present invention, which is adapted to be operated under a low compression load, may be applied to a cooling system which performs only a cooling operation as well as a heating system which performs only a heating operation. A construction of the refrigeration system, which is adapted to execute only a cooling operation or only a heating operation, can be obtained by omitting some dispensable components from the refrigeration systems shown in FIGS. 1 through 20. Since such constructions of the refrigeration system will be apparent to those skilled in the art without departing from the spirit and scope of the invention, a detailed description relating to that is omitted herein. Of course, it is to be understood that all such modifications to the system fall within the spirit and scope of the invention.

While each of the refrigeration systems according to the first to fifth embodiments of the present invention has been described as being constructed by only one indoor unit 20, 120, 220, 320 or 420, the refrigeration system may be constructed into a multi-type refrigeration system having a plurality of indoor units which are connected to each other in series or in parallel. In this case, it is possible to adopt a conventional method in which refrigerant is supplied to some or all of the plurality of indoor units. It is to be understood that the method falls within the spirit and scope of the invention.

Operations of refrigeration systems of air conditioning apparatuses with a bypass line connected between an inlet and an outlet of compressor, according to the first to fifth embodiments of the present invention will now be described.

First, how the cooling and heating operations are performed by a refrigeration system according to the first embodiment of the present invention will be described with reference to FIGS. 2 and 3.

Figure 2:
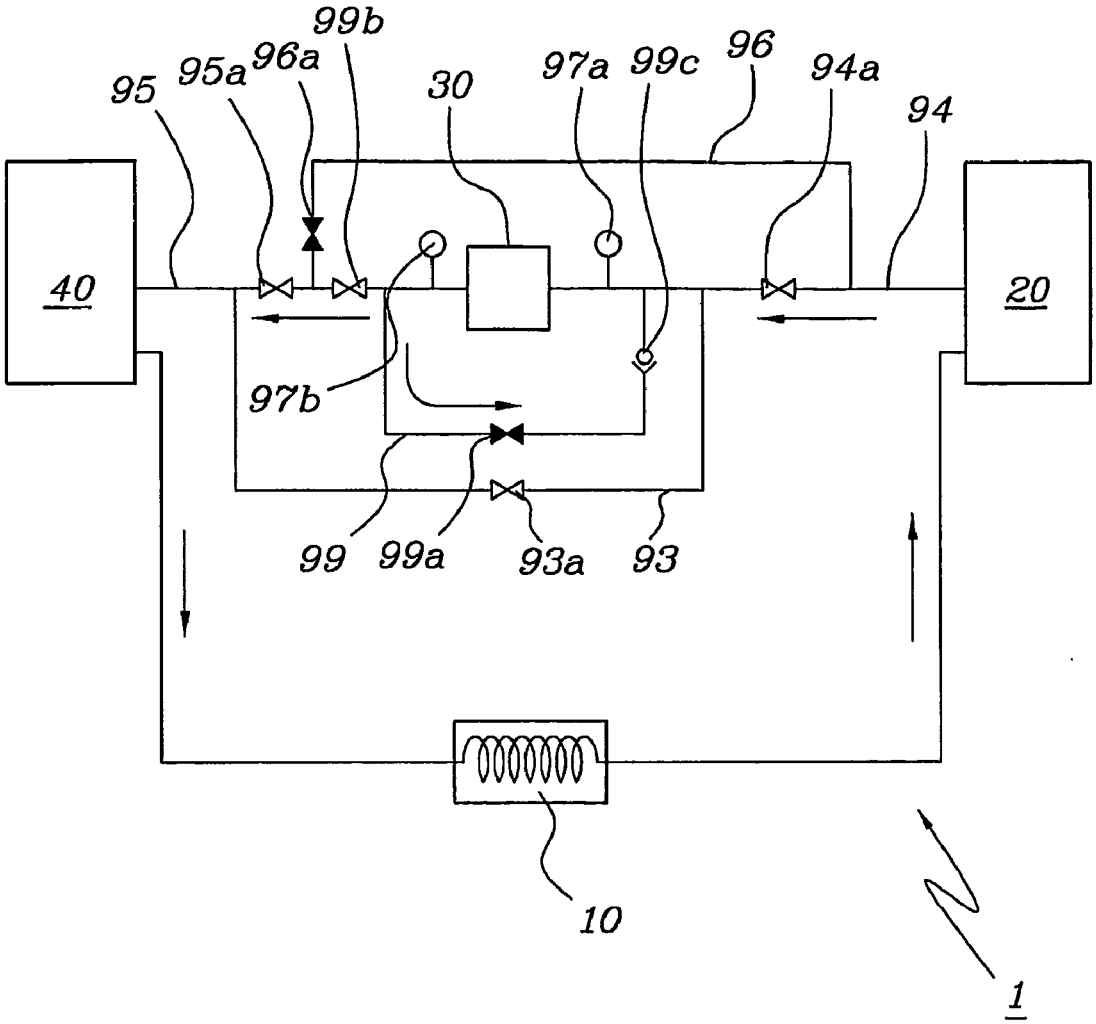
FIG. 2 is a circuit diagram showing the refrigeration system of FIG. 1 in a cooling operation.

Referring to FIG. 2, there is shown the refrigeration system according to the first embodiment of the present invention, which performs a cooling operation. In the cooling operation shown in FIG. 2, the ON/OFF valve 94*a* of the first compressor line 94, the ON/OFF valve 95*a* of the second compressor line 95 and the flow control valve 99*b* of the second compressor line 95 are opened, while the ON/OFF valve 93*a* of the first refrigerant line 93 and the ON/OFF valve 96*a* of the second refrigerant line 96 are closed.

Consequently, refrigerant evaporates in the indoor unit 20 while absorbing heat from air in the room, and is introduced into the compressor 30 through the first compressor line 94.

The refrigerant is discharged from the compressor 30, and introduced into the outdoor unit 40 through the second compressor line 95, where the refrigerant is condensed while radiating heat outside the room. The refrigerant is discharged from the outdoor unit 40, and expanded through the expansion unit 10. The refrigerant is introduced into the indoor unit 20 again, thereby accomplishing a circulation cycle of refrigerant.

In this cooling operation, when a pressure of the refrigerant discharged from the compressor 30 is lower than a preset level, or when an outside temperature of the compressor 30 is lower than a preset level, the bypass valve 99*a* mounted on the bypass line 99 is opened to an appropriate opening degree while an opening degree of the flow control valve 99*b* mounted on the second compressor line 95 is reduced to a corresponding level. Consequently, a part of the refrigerant discharged from the compressor 30 is bypassed to the inlet of the compressor 30 through the refrigerant bypass line 99, where the refrigerant is compressed again. Accordingly, since a pressure of refrigerant supplied to the compressor 30 is increased by the compressor 30, a pressure of refrigerant discharged from the compressor 30 is consequently increased.

In particular, when a pressure of the refrigerant discharged from the compressor 30 is excessively low, the bypass valve 99*a* mounted on the refrigerant bypass line 99 is fully opened while the flow control valve 99*b* mounted on the second compressor line 95 is fully closed, thereby enabling all of the refrigerant discharged from the compressor 30 to be supplied to the compressor 30 again.

When a pressure of the refrigerant discharged from the compressor 30 is increased to a proper level, the bypass valve 99*a* mounted on the refrigerant bypass line 99 is closed while the flow control valve 99*b* mounted on the second compressor line 95 is fully opened, thereby restoring the normal circulation cycle of refrigerant.

Figure 3:
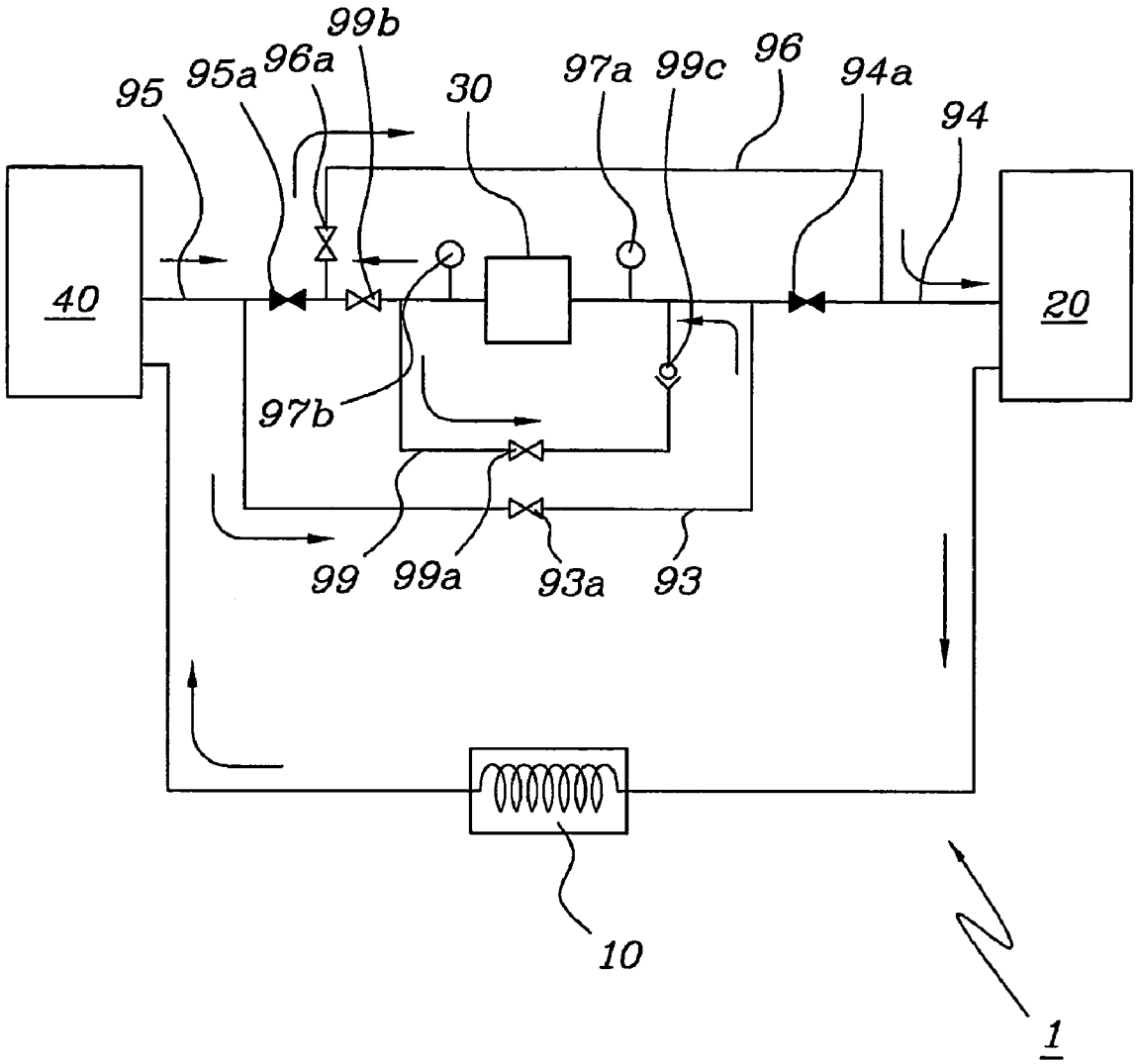
FIG. 3 is a circuit diagram showing the refrigeration system of FIG. 1 in a heating operation.

Referring to FIG. 3, there is shown the refrigeration system according to the first embodiment of the present invention, which performs a heating operation. In the heating operation shown in FIG. 3, the ON/OFF valve 93*a* of the first refrigerant line 93, the ON/OFF valve 96*a* of the second refrigerant line 96 and the flow control valve 99*b* of the second compressor line 95 are opened, while the ON/OFF valve 94*a* of the first compressor line 94 and the ON/OFF valve 95*a* of the second compressor line 95 are closed.

Consequently, refrigerant evaporates in the outdoor unit 40 while absorbing heat from the outside air of the room, and is introduced into the compressor 30 through the second compressor line 95, the first refrigerant line 93 and the first compressor line 94. The refrigerant is discharged from the compressor 30, and introduced into the indoor unit 20 through the second refrigerant line 96, where the refrigerant is condensed while radiating heat to the room. The refrigerant is discharged from the indoor unit 20, and expanded through the expansion unit 10. The refrigerant is introduced into the outdoor unit 40 again, thereby accomplishing a circulation cycle of refrigerant.

In this heating operation, when a pressure of the refrigerant discharged from the compressor 30 is lower than a preset level, or when an outside temperature of the compressor 30 is lower than a preset level, the bypass valve 99*a* mounted on the bypass line 99 is opened to an appropriate opening degree while an opening degree of the flow control valve 99*b* mounted on the second compressor line 95 is reduced to a corresponding level. Consequently, a part of the refrigerant discharged from the compressor 30 is bypassed to the inlet of the compressor 30 through the refrigerant bypass line 99, where the refrigerant is compressed again. Accordingly, since a pressure of refrigerant supplied to the compressor 30 is increased by the compressor 30, a pressure of refrigerant discharged from the compressor 30 is consequently increased.

To sum up, according to the first embodiment of the present invention, when a pressure of the refrigerant discharged from the compressor 30 is lower than a normal level, or when an outside temperature of the compressor 30 is lower than a normal level, due to various factors, a part of all of the refrigerant discharged from the compressor 30 is supplied to the compressor 30 again, to be further compressed, thereby causing the pressure of the refrigerant to reach the normal level.

Next, how the cooling and heating operations are performed by a refrigeration system according to the second embodiment of the present invention will be described with reference to FIGS. 6 and 7.

Figure 6:
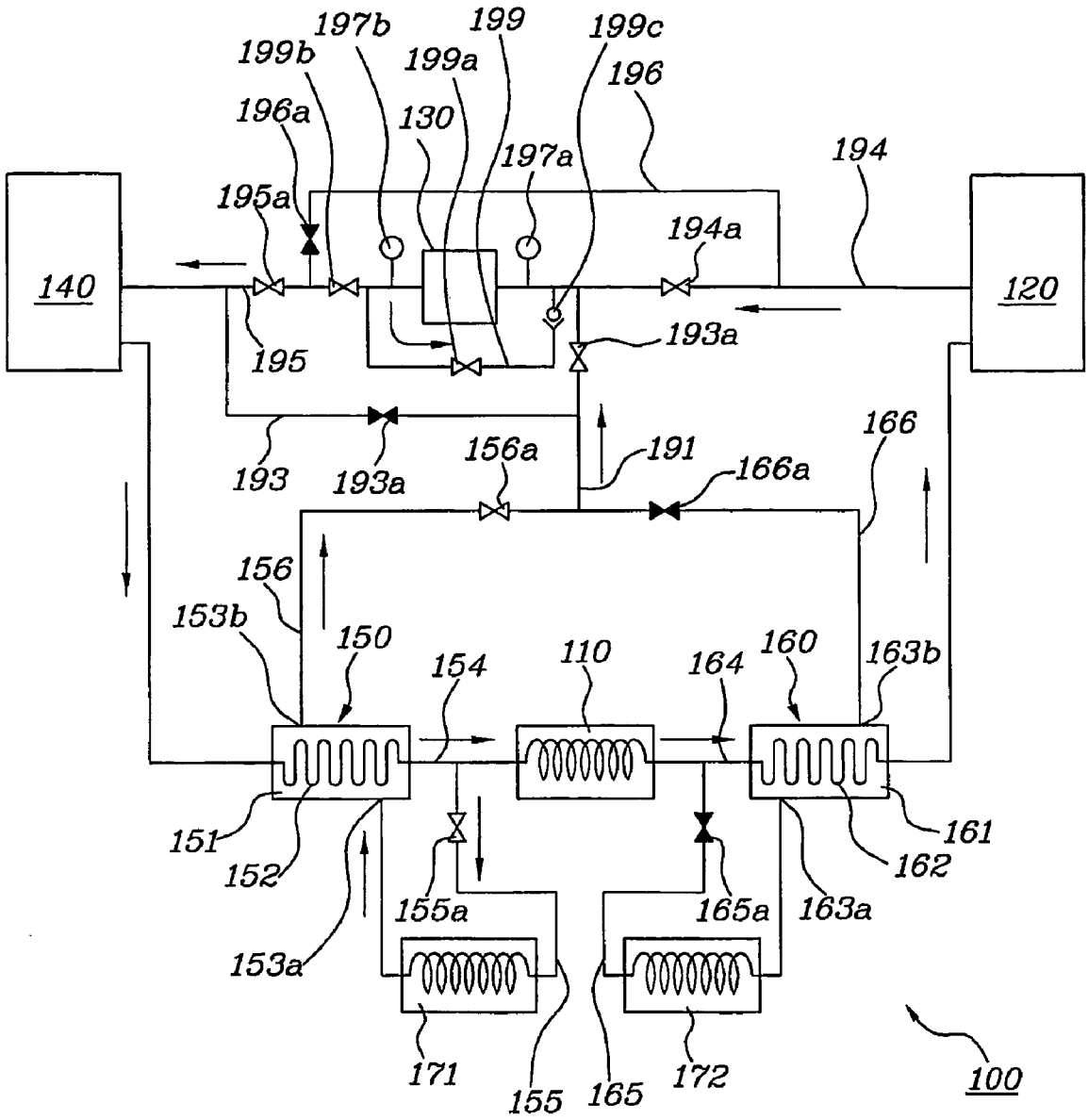
FIG. 6 is a circuit diagram showing the refrigeration system of FIG. 5 in a cooling operation.

Referring to FIG. 6, there is shown the refrigeration system according to the second embodiment of the present invention, which performs a cooling operation. In the cooling operation shown in FIG. 6, the ON/OFF valve 194*a* of the first compressor line 194, the ON/OFF valve 195*a* of the second compressor line 195 and the flow control valve 199*b* of the second compressor line 195 are opened, while the ON/OFF valve 193*a* of the first refrigerant line 193 and the ON/OFF valve 196*a* of the second refrigerant line 196 are closed.

Consequently, refrigerant evaporates in the indoor unit 120 while absorbing heat from air in the room, and is introduced into the compressor 130 through the first compressor line 194. The refrigerant is discharged from the compressor 130, and introduced into the outdoor unit 140 through the second compressor line 195, where the refrigerant is condensed while radiating heat outside the room. The refrigerant is discharged from the outdoor unit 140, and expanded through the expansion unit 110. The refrigerant is introduced into the indoor unit 120 again, thereby accomplishing a circulation cycle of refrigerant.

At this point, the flow control valve 155*a* of the first bypass line 155 branched from the first line 154 located upstream of the expansion unit 110 is opened to an appropriate opening degree, while the flow control valve 165*a* of the second bypass line 165 branched from the second line 164 located downstream of the expansion unit 110 is closed.

Consequently, a part of the refrigerant to be introduced into the expansion unit 110 is introduced into the first auxiliary expansion unit 171 through the first bypass line 155, where the refrigerant is expanded. Accordingly, refrigerant introduced into the first auxiliary evaporator 150 through the refrigerant inlet 153*a* and refrigerant flowing to the expansion unit 110 from the outdoor unit 140 exchange heat with each other.

At the same time, the ON/OFF valve 156*a* of the first lower temperature-refrigerant outflow line 156 and the ON/OFF valve 193*b* of the first refrigerant line 193 are opened, while the ON/OFF valve 166*a* of the second lower temperature-refrigerant outflow line 166 is closed.

Consequently, refrigerant discharged from the refrigerant outlet 153*b* of the first auxiliary evaporator 150 is introduced into the first compressor line 194 through the first lower temperature-refrigerant outflow line 156, the lower temperature-refrigerant feeding line 191 and the first refrigerant line 193, where the refrigerant is mixed with refrigerant discharged from the indoor unit 120, and the mixed refrigerant is supplied to the compressor 130.

Since the flow control valve 165*a* of the second bypass line 165 is closed, refrigerant discharged from the expansion unit 110 is supplied to the indoor unit 120 through the second auxiliary evaporator 160 without any changes.

In this cooling operation, when a pressure of the refrigerant discharged from the compressor 130 is lower than a preset level, or when an outside temperature of the compressor 130 is lower than a preset level, the bypass valve 199*a* mounted on the bypass line 199 is opened to an appropriate opening degree while an opening degree of the flow control valve 199*b* mounted on the second compressor line 195 is reduced to a corresponding level. Consequently, a part of the refrigerant discharged from the compressor 130 is bypassed to the inlet of the compressor 130 through the refrigerant bypass line 199, where the refrigerant is compressed again. Accordingly, since a pressure of refrigerant supplied to the compressor 130 is increased by the compressor 130, a pressure of refrigerant discharged from the compressor 130 is consequently increased.

In particular, when a pressure of the refrigerant discharged from the compressor 130 is excessively low, the bypass valve 199*a* mounted on the refrigerant bypass line 199 is fully opened while the flow control valve 199*b* mounted on the second compressor line 195 is fully closed, thereby enabling all of the refrigerant discharged from the compressor 130 to be supplied to the compressor 130 again.

When a pressure of the refrigerant discharged from the compressor 130 is increased to a proper level, the bypass valve 199*a* mounted on the refrigerant bypass line 199 is closed while the flow control valve 199*b* mounted on the second compressor line 195 is fully opened, thereby restoring the normal circulation cycle of refrigerant.

An example of the state of the refrigerant in the cooling operation, which is performed by the refrigeration system 100 according to the second embodiment of the present invention, will now be described.

Refrigerant of 25° C. discharged from the outdoor unit 140 passes through the first auxiliary evaporator 150 while being cooled to 5° C., and is introduced into the expansion unit 110. More specifically, a part, for example, 50% of the refrigerant discharged from the first auxiliary evaporator 150 passes through the first bypass line 155 and the first auxiliary expansion unit 171 while being cooled to −15° C., and is introduced into the first auxiliary evaporator 150, thereby allowing the refrigerant of −15° C. to exchange heat with the refrigerant of 25° C. discharged from the outdoor unit 140 in the first auxiliary evaporator 150. That is, by the heat exchange, the refrigerant discharged to the expansion unit 110 from the first auxiliary evaporator 150 is cooled to 5° C., while the refrigerant discharged to the refrigerant outlet 153*b* of the first auxiliary evaporator 150 is warmed to 0° C.

The refrigerant of 5° C. introduced into the expansion unit 110 passes through the expansion unit 110 while being cooled to −15° C., and the refrigerant in a state of lower temperature and lower pressure is introduced into the indoor unit 120, where the refrigerant is warmed to 10° C. Consequently, the refrigerant of 0° C. discharged from the refrigerant outlet 153*b* of the first auxiliary evaporator 150 is mixed with the refrigerant of 10° C. discharged from the indoor unit 120 in the compressor 130, thereby allowing a temperature of the mixed refrigerant in the compressor 130 to become 5° C. which is a mean value between 0° C. and 10° C.

Figure 7:
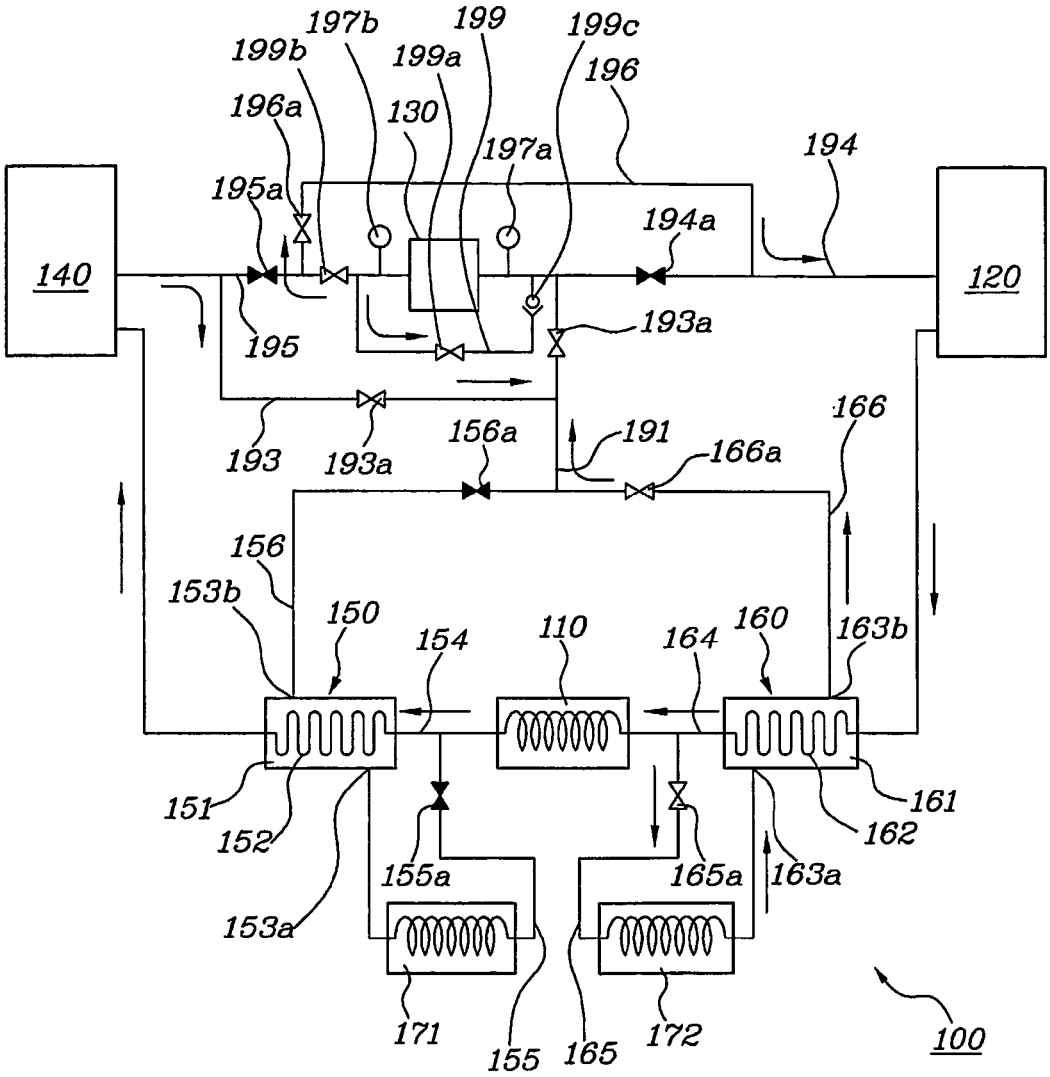
FIG. 7 is a circuit diagram showing the refrigeration system of FIG. 5 in a heating operation.

Referring to FIG. 7, there is shown the refrigeration system according to the second embodiment of the present invention, which performs a heating operation. In the heating operation shown in FIG. 7, the flow control valve 199*b* of the second compressor line 195, the ON/OFF valve 193*a* of the first refrigerant line 193 and the ON/OFF valve 196*a* of the second refrigerant line 196 are opened, while the ON/OFF valve 195*a* of the second compressor line 195 and the ON/OFF valve 194*a* of the first compressor line 194 are closed.

Consequently, refrigerant evaporates in the outdoor unit 140 while absorbing heat from the outside air of the room, and is introduced into the compressor 130 through the first refrigerant line 198 and the first compressor line 194. The refrigerant is discharged from the compressor 130, and introduced into the indoor unit 120 through the second refrigerant line 196, where the refrigerant is condensed while radiating heat to the room. The refrigerant is discharged from the indoor unit 120, and expanded through the expansion unit 110. The refrigerant is introduced into the outdoor unit 140 again, thereby accomplishing a circulation cycle of refrigerant.

At this point, the flow control valve 165*a* of the second bypass line 165 branched from the second line 164 located upstream of the expansion unit 110 is opened, while the flow control valve 155*a* of the first bypass line 155 branched from the first line 154 located downstream of the expansion unit 110 is closed.

Consequently, a part of the refrigerant to be introduced into the expansion unit 110 is introduced into the second auxiliary expansion unit 172 through the second bypass line 165, where the refrigerant is expanded. Accordingly, refrigerant introduced into the second auxiliary evaporator 160 through the refrigerant inlet 163*a* and refrigerant flowing to the expansion unit 110 from the indoor unit 120 exchange heat with each other.

At the same time, the flow control valve 166*a* of the second lower temperature-refrigerant outflow line 166 is opened, while the flow control valve 156*a* of the first lower temperature-refrigerant outflow line 156 is closed.

Consequently, refrigerant discharged from the refrigerant outlet 163*b* of the second auxiliary evaporator 160 is introduced into the first compressor line 194 through the second lower temperature-refrigerant outflow line 166, the lower temperature-refrigerant feeding line 191 and the first refrigerant line 193, where the refrigerant is mixed with refrigerant discharged from the outdoor unit 140, and the mixed refrigerant is supplied to the compressor 130.

Since the flow control valve 155*a* of the first bypass line 155 is closed, refrigerant discharged from the expansion unit 110 is supplied to the outdoor unit 140 through the first auxiliary evaporator 150 without any changes.

In this heating operation, when a pressure of the refrigerant discharged from the compressor 130 is lower than a preset level, or when an outside temperature of the compressor 130 is lower than a preset level, the bypass valve 199*a* mounted on the bypass line 199 is opened to an appropriate opening degree while an opening degree of the flow control valve 199*b* mounted on the second compressor line 195 is reduced to a corresponding level. Consequently, a part of the refrigerant discharged from the compressor 130 is bypassed to the inlet of the compressor 130 through the refrigerant bypass line 199, where the refrigerant is compressed again. Accordingly, since a pressure of refrigerant supplied to the compressor 130 is increased by the compressor 130, a pressure of refrigerant discharged from the compressor 130 is consequently increased.

An example of the state of the refrigerant in the heating operation, which is performed by the refrigeration system 100 according to the second embodiment of the present invention, will now be described.

Refrigerant of 25° C. discharged from the indoor unit 120 passes through the second auxiliary evaporator 160 while being cooled to 5° C., and is introduced into the expansion unit 110. More specifically, a part, for example, 50% of the refrigerant discharged from the second auxiliary evaporator 160 passes through the second bypass line 165 and the second auxiliary expansion unit 172 while being cooled to −15° C., and is introduced into the second auxiliary evaporator 160, thereby allowing the refrigerant of −15° C. to exchange heat with the refrigerant of 25° C. discharged from the indoor unit 120 in the second auxiliary evaporator 160. That is, by the heat exchange, the refrigerant discharged to the expansion unit 110 from the second auxiliary evaporator 160 is cooled to 5° C., while the refrigerant discharged to the refrigerant outlet 163*b* of the second auxiliary evaporator 160 is warmed to 0° C.

The refrigerant of 5° C. introduced into the expansion unit 110 passing through the expansion unit 110 while being cooled to −15° C., and the refrigerant in a state of lower temperature and lower pressure is introduced into the outdoor unit 140, where the refrigerant is warmed to 10° C. Consequently, the refrigerant of 0° C. discharged from the refrigerant outlet 163*b* of the second auxiliary evaporator 160 is mixed with the refrigerant of 10° C. discharged from the outdoor unit 140 in the compressor 130, thereby allowing a temperature of the mixed refrigerant in the compressor 130 to become 5° C. which is a mean value between 0° C. and 10° C.

To sum up, according to the second embodiment of the present invention, when a pressure of the refrigerant discharged from the compressor 130 is lower than a normal level, or when an outside temperature of the compressor 130 is lower than a normal level, due to various factors, a part of all of the refrigerant discharged from the compressor 130 is supplied to the compressor 130 again, to be further compressed, thereby causing the pressure of the refrigerant to reach the normal level. If it is required to prevent a temperature of the refrigerant discharged from the compressor 130 from excessively rising, a part of the lower temperature-refrigerant is supplied to the inlet of the compressor 130.

Next, how the cooling and heating operations are performed by a refrigeration system according to the third embodiment of the present invention will be described with reference to FIGS. 10 and 11.

Figure 10:
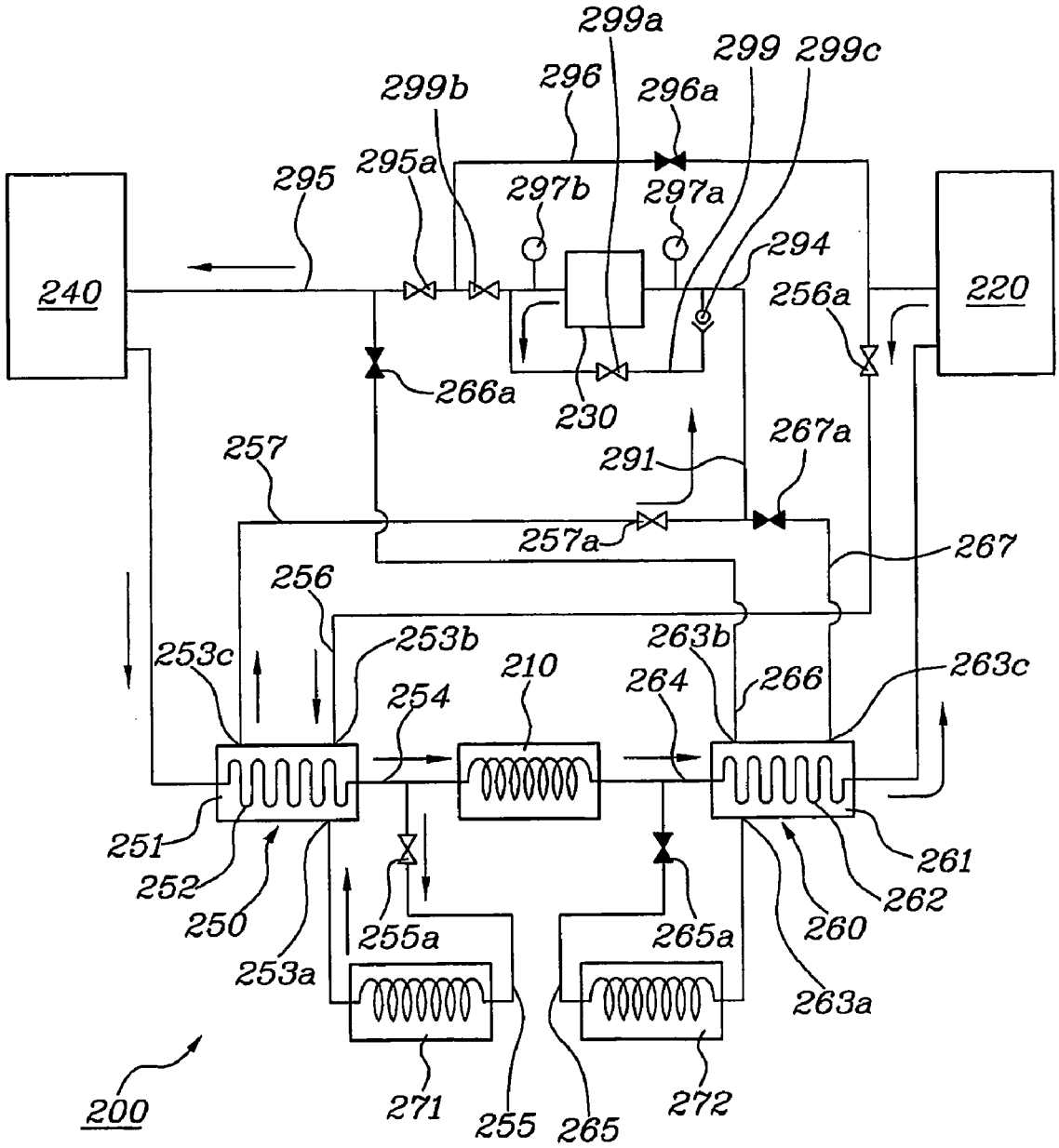
FIG. 10 is a circuit diagram showing the refrigeration system of FIG. 9 in a cooling operation.

Referring to FIG. 10, there is shown the refrigeration system according to the third embodiment of the present invention, which performs a cooling operation. In the cooling operation shown in FIG. 10, the ON/OFF valve 256*a* of the first higher temperature-refrigerant inflow line 256, the ON/OFF valve 257*a* of the first lower temperature-refrigerant outflow line 257, and the ON/OFF valve 296*a* and the flow control valve 299*b* of the second compressor line 295 are opened, while the ON/OFF valve 296*a* of the refrigerant line 296, the ON/OFF valve 267*a* of the second lower temperature-refrigerant outflow line 267 and the ON/OFF valve 266*a* of the second higher temperature-refrigerant inflow line 266 are closed.

Consequently, refrigerant evaporates in the indoor unit 220 while absorbing heat from air in the room, and is introduced into the compressor 230 through the first higher temperature-refrigerant inflow line 256, the first temperature-refrigerant outflow line 257 and the first compressor line 294. The refrigerant is discharged from the compressor 230, and introduced into the outdoor unit 240 through the second compressor line 295, where the refrigerant is condensed while radiating heat outside the room. The refrigerant is discharged from the outdoor unit 240, and expanded through the expansion unit 210. The refrigerant is introduced into the indoor unit 220 again, thereby accomplishing a circulation cycle of refrigerant.

At this point, the flow control valve 255*a* of the first bypass line 255 branched from the first line 254 located upstream of the expansion unit 210 is opened, while the flow control valve 265*a* of the second bypass line 265 branched from the second line 264 located downstream of the expansion unit 210 is closed.

Consequently, a part of the refrigerant to be introduced into the expansion unit 210 is introduced into the first auxiliary expansion unit 271 through the first bypass line 255, where the refrigerant is expanded. Accordingly, refrigerant introduced into the first auxiliary evaporator 250 through the refrigerant inlets 253*a* and 253*b* and refrigerant flowing to the expansion unit 210 from the outdoor unit 240 exchange heat with each other. That is, higher temperature-refrigerant discharged from the indoor unit 220 is mixed with lower temperature-refrigerant discharged from the first auxiliary expansion unit 271, and the mixed refrigerant exchanges heat with refrigerant discharged from the outdoor unit 240 in the first auxiliary evaporator 250.

Refrigerant discharged from the refrigerant outlet 253*c* of the first auxiliary evaporator 250 is introduced into the first compressor line 294 through the first lower temperature-refrigerant outflow line 257, and thus supplied to the compressor 230.

Since the flow control valve 265*a* of the second bypass line 265 is closed, refrigerant discharged from the expansion unit 210 is supplied to the indoor unit 220 through the second auxiliary evaporator 260 without any changes.

In this cooling operation, when a pressure of the refrigerant discharged from the compressor 230 is lower than a preset level, or when an outside temperature of the compressor 230 is lower than a preset level, the bypass valve 299*a* mounted on the refrigerant bypass line 299 is opened to an appropriate opening degree while an opening degree of the flow control valve 299*b* mounted on the second compressor line 295 is reduced to a corresponding level. Consequently, a part of the refrigerant discharged from the compressor 230 is bypassed to the inlet of the compressor 230 through the refrigerant bypass line 299, where the refrigerant is compressed again. Accordingly, since a pressure of refrigerant supplied to the compressor 230 is increased by the compressor 230, a pressure of refrigerant discharged from the compressor 230 is consequently increased.

In particular, when a pressure of the refrigerant discharged from the compressor 230 is excessively low, the bypass valve 299*a* mounted on the refrigerant bypass line 299 is fully opened while the flow control valve 299*b* mounted on the second compressor line 295 is fully closed, thereby enabling all of the refrigerant discharged from the compressor 230 to be supplied to the compressor 230 again.

When a pressure of the refrigerant discharged from the compressor 230 is increased to a proper level, the bypass valve 299*a* mounted on the refrigerant bypass line 299 is closed while the flow control valve 299*b* mounted on the second compressor line 295 is fully opened, thereby restoring the normal circulation cycle of refrigerant.

An example of the state of the refrigerant in the cooling operation, which is performed by the refrigeration system 200 according to the third embodiment of the present invention, will now be described.

Refrigerant of 25° C. discharged from the outdoor unit 240 passes through the first auxiliary evaporator 250 while being cooled to 5° C., and is introduced into the expansion unit 210. More specifically, a part, for example, 50% of the refrigerant discharged from the first auxiliary evaporator 250 passes through the first bypass line 255 and the first auxiliary expansion unit 271 while being cooled to −15° C., and is introduced into the first auxiliary evaporator 250. The refrigerant of −15° C. discharged from the first auxiliary evaporator 250 is introduced into the expansion unit 210, where the refrigerant is changed into a refrigerant in a state of lower temperature of −15° C. and lower pressure. The refrigerant in a state of lower temperature of −15° C. and lower pressure is introduced into the indoor unit 220, where the refrigerant is warmed to 10° C. The refrigerant of 10° C. is introduced into the first auxiliary evaporator 250 through the first higher temperature-refrigerant inflow line 256, where the refrigerant is mixed with refrigerant introduced therein through the first auxiliary expansion unit 271. The mixed refrigerant exchanges heat with the refrigerant of 25° C. discharged from the outdoor unit 240 in the first auxiliary evaporator 250. As a result, refrigerant of a predetermined temperature, for example, 5° C. is introduced into the compressor 230 through the first lower temperature-refrigerant outflow line 257, the lower temperature-refrigerant feeding line 291 and first compressor line 294.

Figure 11:
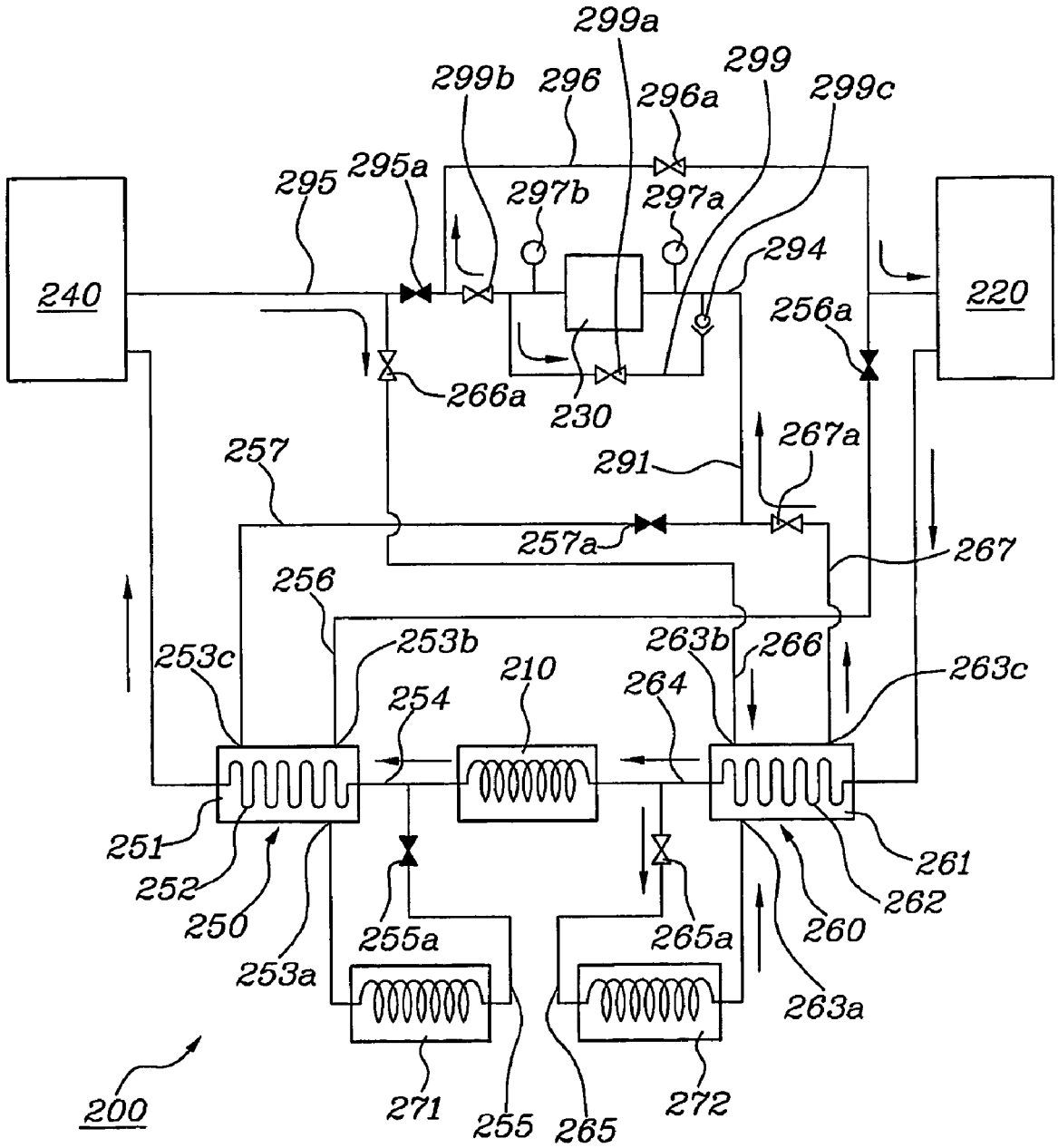
FIG. 11 is a circuit diagram showing the refrigeration system of FIG. 9 in a heating operation.

Referring to FIG. 11, there is shown the refrigeration system according to the third embodiment of the present invention, which performs a heating operation. In the heating operation shown in FIG. 11, the ON/OFF valve 266*a* of the second higher temperature-refrigerant inflow line 266, the ON/OFF valve 267*a* of the second lower temperature-refrigerant outflow line 267, the ON/OFF valve 296*a* of the refrigerant line 296 and the flow control valve 299*b* of the second compressor line 295 are opened, while the ON/OFF valve 295*a* of the second compressor line 295, the ON/OFF valve 257*a* of the second lower temperature-refrigerant outflow line 257 and the ON/OFF valve 256*a* of the first higher temperature-refrigerant inflow line 256 are closed.

Consequently, refrigerant evaporates in the outdoor unit 240 while absorbing heat from the outside air of the room, and is introduced into the compressor 230 through the second higher temperature-refrigerant inflow line 266, the second lower temperature-refrigerant outflow line 267 and the first compressor line 294. The refrigerant is discharged from the compressor 230, and introduced into the indoor unit 220 through the second compressor line 295, where the refrigerant is condensed while radiating heat to the room. The refrigerant is discharged from the indoor unit 220, and expanded through the expansion unit 210. The refrigerant is introduced into the outdoor unit 240 again, thereby accomplishing a circulation cycle of refrigerant.

At this point, the flow control valve 265*a* of the second bypass line 265 branched from the second line 264 located upstream of the expansion unit 210 is opened, while the flow control valve 255*a* of the first bypass line 255 branched from the first line 254 located downstream of the expansion unit 210 is closed.

Consequently, a part of the refrigerant to be introduced into the expansion unit 210 is introduced into the second auxiliary expansion unit 272 through the second bypass line 265, where the refrigerant is expanded. Accordingly, refrigerant introduced into the second auxiliary evaporator 260 through the refrigerant inlets 263*a* and 263*b* and refrigerant flowing to the expansion unit 210 from the indoor unit 220 exchange heat with each other. That is, the higher temperature-refrigerant discharged from the outdoor unit 240 and the refrigerant discharged from the second auxiliary expansion unit 272 are mixed, and the mixed refrigerant exchanges heat with the refrigerant discharged from the indoor unit 220 in the second auxiliary evaporator 260.

The refrigerant discharged from the refrigerant outlet 263*c* of the second auxiliary evaporator 260 is introduced into the compressor 230 through the second lower temperature-refrigerant outflow line 267 and the first compressor line 294.

Since the flow control valve 255*a* of the first bypass line 255 is closed, refrigerant discharged from the expansion unit 210 is supplied to the outdoor unit 240 through the first auxiliary evaporator 250 without any changes.

In this heating operation, when a pressure of the refrigerant discharged from the compressor 230 is lower than a preset level, or when an outside temperature of the compressor 230 is lower than a preset level, the bypass valve 299*a* mounted on the refrigerant bypass line 299 is opened to an appropriate opening degree while an opening degree of the flow control valve 299*b* mounted on the second compressor line 295 is reduced to a corresponding level. Consequently, a part of the refrigerant discharged from the compressor 230 is bypassed to the inlet of the compressor 230 through the refrigerant bypass line 299, where the refrigerant is compressed again. Accordingly, since a pressure of refrigerant supplied to the compressor 230 is increased by the compressor 230, a pressure of refrigerant discharged from the compressor 230 is consequently increased.

An example of the state of the refrigerant in the heating operation, which is performed by the refrigeration system 200 according to the third embodiment of the present invention, will now be described.

Refrigerant of 25° C. discharged from the indoor unit 220 passes through the second auxiliary evaporator 260 while being cooled to 5° C., and is introduced into the expansion unit 210. More specifically, a part, for example, 50% of the refrigerant discharged from the second auxiliary evaporator 260 passes through the second bypass line 265 and the second auxiliary expansion unit 272 while being cooled to −15° C., and is introduced into the second auxiliary evaporator 260. The refrigerant of −15° C. discharged from the second auxiliary evaporator 260 is introduced into the expansion unit 210, where the refrigerant is changed into a refrigerant in a state of lower temperature of −15° C. and lower pressure. The refrigerant in a state of lower temperature of −15° C. and lower pressure is introduced into the outdoor unit 240, where the refrigerant is warmed to 10° C. The refrigerant of 10° C. is introduced into the second auxiliary evaporator 260 through the second higher temperature-refrigerant inflow line 266, where the refrigerant is mixed with refrigerant introduced therein through the second auxiliary expansion unit 272. The mixed refrigerant exchanges heat with the refrigerant of 25° C. discharged from the indoor unit 220 in the second auxiliary evaporator 260. As a result, refrigerant of a predetermined temperature, for example, 5° C. is introduced into the compressor 230 through the second lower temperature-refrigerant outflow line 267, the lower temperature-refrigerant feeding line 291 and first compressor line 294.

To sum up, according to the third embodiment of the present invention, when a pressure of the refrigerant discharged from the compressor 230 is lower than a normal level, or when an outside temperature of the compressor 230 is lower than a normal level, due to various factors, a part of all of the refrigerant discharged from the compressor 230 is supplied to the compressor 230 again, to be further compressed, thereby causing the pressure of the refrigerant to reach the normal level. If it is required to prevent a temperature of the refrigerant discharged from the compressor 230 from excessively rising, a part of the lower temperature-refrigerant is supplied to the inlet of the compressor 230.

Next, how the cooling and heating operations are performed by a refrigeration system according to the fourth embodiment of the present invention will be described with reference to FIGS. 14 and 15.

Figure 14:
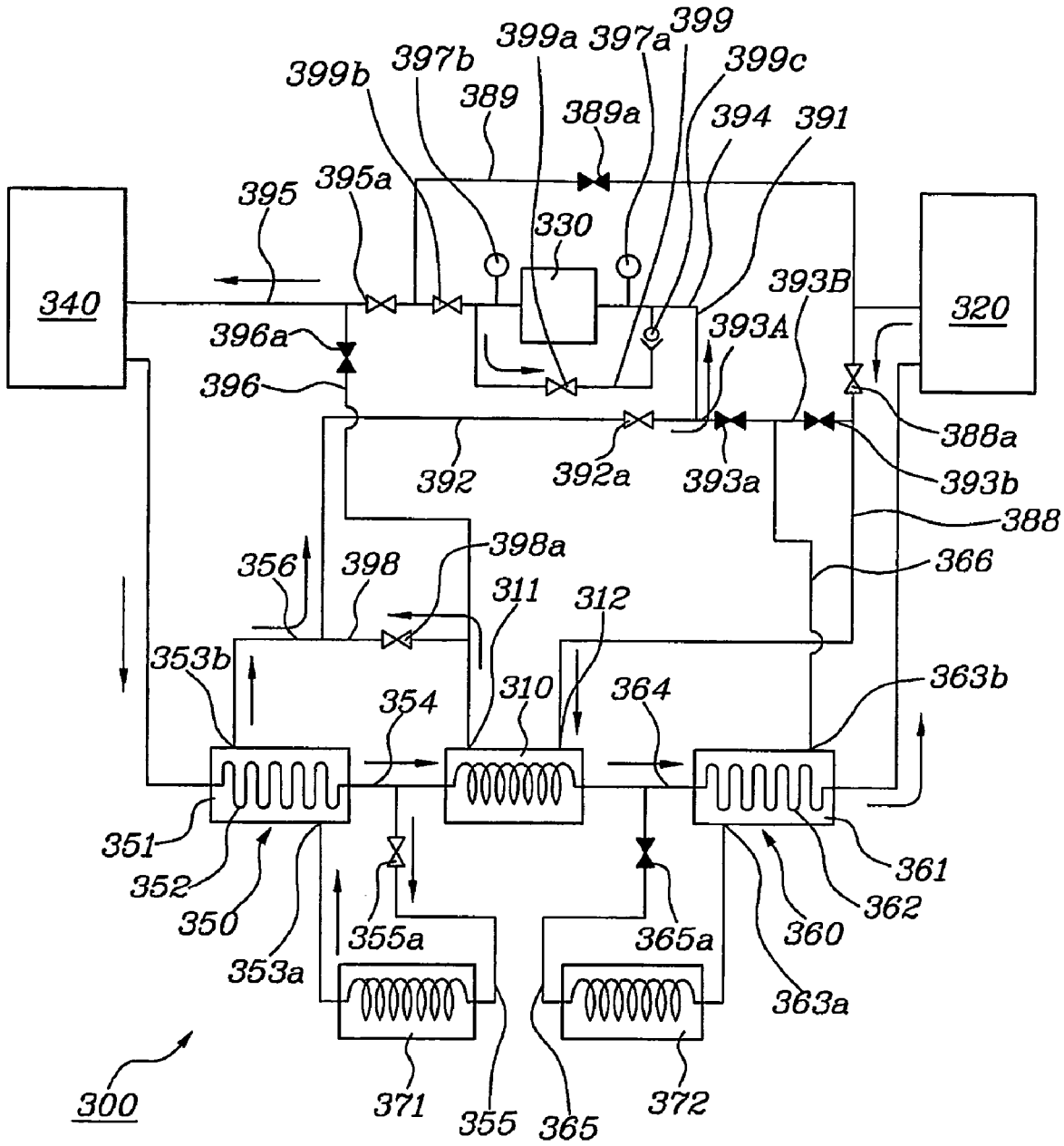
FIG. 14 is a circuit diagram showing the refrigeration system of FIG. 13 in a cooling operation.

Referring to FIG. 14, there is shown the refrigeration system according to the fourth embodiment of the present invention, which performs a cooling operation. In the cooling operation shown in FIG. 14, the ON/OFF valve 388*a* of the sixth connecting line 388, the ON/OFF valve 398*a* of the fifth connecting line 398, the ON/OFF valve 392*a* of the first connecting line 392 and the ON/OFF valve 395*a* and the flow control valve 399*b* of the second compressor line 395 are opened, while the ON/OFF valve 389*a* of the fourth connecting line 389, the ON/OFF valve 393*b* of the seventh connecting line 393B, the ON/OFF valve 366*a* of the third connecting line 396 and the ON/OFF valve 393*a* of the second connecting line 393A are closed.

Consequently, refrigerant evaporates in the indoor unit 320 while absorbing heat from air in the room, and is introduced into the compressor 330 through the sixth connecting line 388, the fifth connecting line 398, the first connecting line 302 and the first compressor line 394. The refrigerant is discharged from the compressor 330, and introduced into the outdoor unit 340 through the second compressor line 395, where the refrigerant is condensed while radiating heat outside the room. The refrigerant is discharged from the outdoor unit 340, and expanded through the expansion unit 310. The refrigerant is introduced into the indoor unit 320 again, thereby accomplishing a circulation cycle of refrigerant.

At this point, the flow control valve 355*a* of the first bypass line 355 branched from the first line 354 located upstream of the expansion unit 310 is opened, while the flow control valve 365*a* of the second bypass line 365 branched from the second line 364 located downstream of the expansion unit 310 is closed.

Consequently, a part of the refrigerant to be introduced into the expansion unit 310 is introduced into the first auxiliary expansion unit 371 through the first bypass line 355, where the refrigerant is expanded. Accordingly, refrigerant introduced into the first auxiliary evaporator 350 through the refrigerant inlet 353*a* and refrigerant flowing to the expansion unit 310 from the outdoor unit 340 exchange heat with each other.

The refrigerant discharged from the refrigerant outlet 353*b* of the first auxiliary evaporator 350 is introduced into the first connecting line 392 through the first lower temperature-refrigerant outflow line 356, while refrigerant discharged from the indoor unit 320 is subjected to heat exchange through the expansion unit 310, and introduced into the first connecting line 392 through the fifth connecting line 398. The two refrigerants are mixed in the first connecting line 392, and the mixed refrigerant is supplied to the compressor 330 through the lower temperature-refrigerant feeding line 391 and the first compressor line 394.

Since the flow control valve 365*a* of the second bypass line 365 is closed, refrigerant discharged from the expansion unit 310 is supplied to the indoor unit 320 through the second auxiliary evaporator 360 without any changes.

In this cooling operation, when a pressure of the refrigerant discharged from the compressor 330 is lower than a preset level, or when an outside temperature of the compressor 330 is lower than a preset level, the bypass valve 399*a* mounted on the bypass line 399 is opened to an appropriate opening degree while an opening degree of the flow control valve 399*b* mounted on the second compressor line 395 is reduced to a corresponding level. Consequently, a part of the refrigerant discharged from the compressor 330 is bypassed to the inlet of the compressor 330 through the refrigerant bypass line 399, where the refrigerant is compressed again. Accordingly, since a pressure of refrigerant supplied to the compressor 330 is increased by the compressor 330, a pressure of refrigerant discharged from the compressor 330 is consequently increased.

In particular, when a pressure of the refrigerant discharged from the compressor 330 is excessively low, the bypass valve 399*a* mounted on the refrigerant bypass line 399 is fully opened while the flow control valve 399*b* mounted on the second compressor line 395 is fully closed, thereby enabling all of the refrigerant discharged from the compressor 330 to be supplied to the compressor 330 again.

When a pressure of the refrigerant discharged from the compressor 330 is increased to a proper level, the bypass valve 399*a* mounted on the refrigerant bypass line 399 is closed while the flow control valve 399*b* mounted on the second compressor line 395 is fully opened, thereby restoring the normal circulation cycle of refrigerant.

An example of the state of the refrigerant in the cooling operation, which is performed by the refrigeration system 300 according to the fourth embodiment of the present invention, will now be described.

Refrigerant of 25° C. discharged from the outdoor unit 340 passes through the first auxiliary evaporator 350 while being cooled to 5° C., and is introduced into the expansion unit 310. More specifically, a part, for example, 50% of the refrigerant discharged from the first auxiliary evaporator 350 passes through the first bypass line 355 and the first auxiliary expansion unit 371 while being cooled to −15° C., and is introduced into the first auxiliary evaporator 350. The refrigerant of −15° C. exchanges heat with the refrigerant of 25° C. discharged from the outdoor unit 340 in the first auxiliary evaporator 350. As a result, the refrigerant discharged from the first auxiliary evaporator 350 to the expansion unit 310 has a temperature of 5° C., and the refrigerant discharged from the refrigerant outlet 353*b* of the first auxiliary evaporator 350 has a temperature of 0° C.

The refrigerant of 5° C. introduced into the expansion unit 310 passes through the expansion unit 310 while being cooled to −15° C., and the refrigerant in a state of lower temperature and lower pressure is introduced into the indoor unit 320, where the refrigerant is warmed to 10° C. The refrigerant, which is introduced into the expansion unit 310 from the indoor unit 320, is warmed to 15° C. by heat exchange with the refrigerant expanded through the first auxiliary evaporator 350. Accordingly, since the refrigerant of 0° C. discharged from the refrigerant outlet 353*b* of the first auxiliary evaporator 350 and the refrigerant of 15° C. discharged from the indoor unit 320 through the expansion unit 310 are introduced into the compressor 330, the mixed refrigerant in the compressor 330 has a temperature between 0° C. and 15° C., preferably about 5° C.

Figure 15:
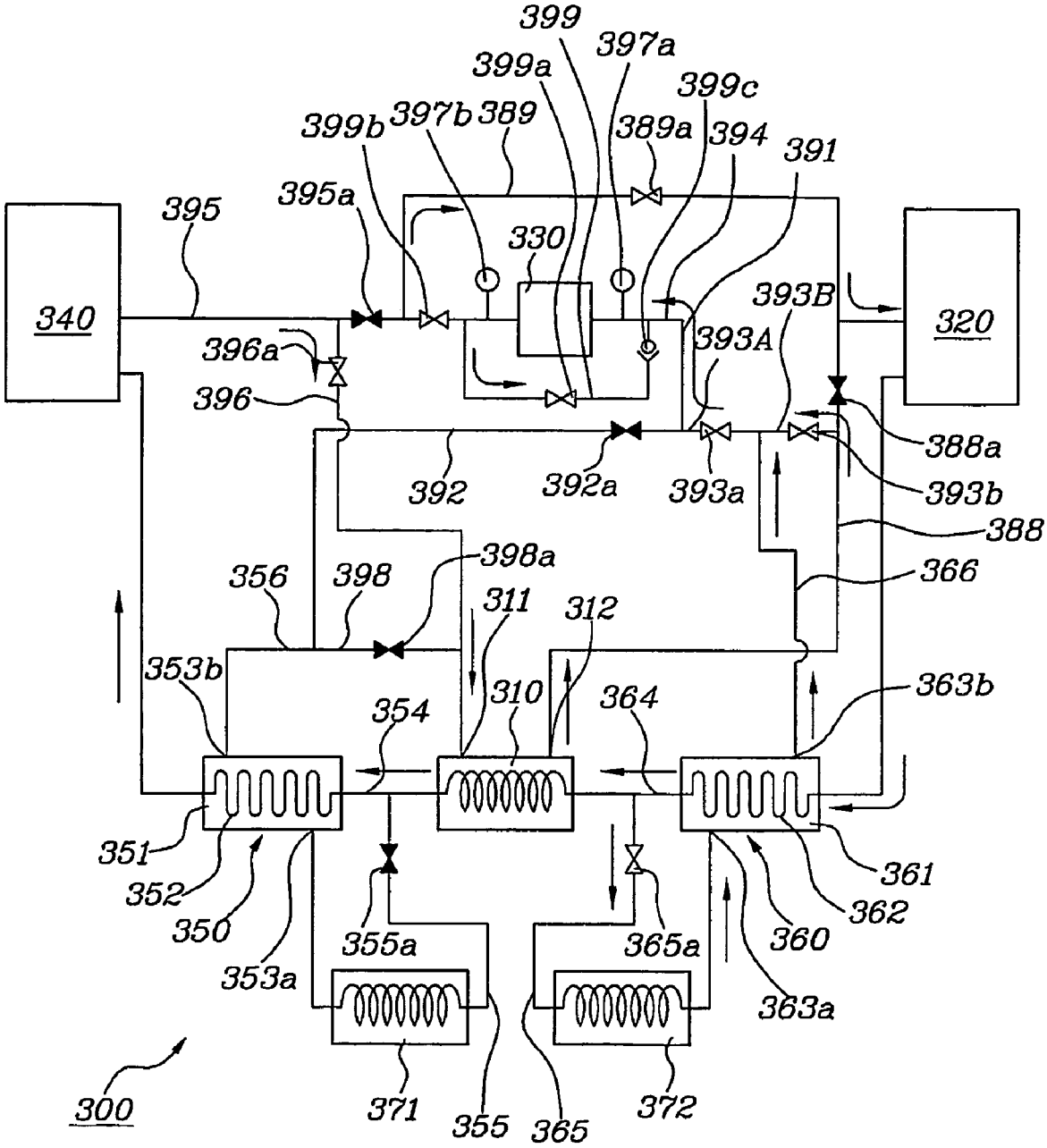
FIG. 15 is a circuit diagram showing the refrigeration system of FIG. 13 in a heating operation.

Referring to FIG. 15, there is shown the refrigeration system according to the fourth embodiment of the present invention, which performs a heating operation. In the heating operation shown in FIG. 15, the ON/OFF valve 396*a* of the third connecting line 396, the ON/OFF valve 393*b* of the seventh connecting line 393B, the ON/OFF valve 303*a* of the second connecting line 303A, the ON/OFF valve 389*a* of the fourth connecting line 380 and the flow control valve 399*b* of the second compressor line 395 are opened, while the ON/OFF valve 395*a* of the second compressor line 395, the ON/OFF valve 398*a* of the fifth connecting line 398, the ON/OFF valve 388*a* of the sixth connecting line 388 and the ON/OFF valve 392*a* of the first connecting line 392 are closed.

Consequently, refrigerant evaporates in the outdoor unit 340 while absorbing heat from the outside air of the room, and is introduced into the compressor 330 through the third connecting line 396, the seventh connecting line 393B, the second connecting line 393A, the lower temperature-refrigerant feeding line 391 and the first compressor line 394. The refrigerant is discharged from the compressor 330, and introduced into the indoor unit 320 through the fourth connecting line 389, where the refrigerant is condensed while radiating heat to the room. The refrigerant is discharged from the indoor unit 320, and expanded through the expansion unit 310. The refrigerant is introduced into the outdoor unit 340 again, thereby accomplishing a circulation cycle of refrigerant.

At this point, the flow control valve 365*a* of the second bypass line 365 branched from the second line 364 located upstream of the expansion unit 310 is opened, while the flow control valve 355*a* of the first bypass line 355 branched from the first line 354 located downstream of the expansion unit 310 is closed.

Consequently, a part of the refrigerant to be introduced into the expansion unit 310 is introduced into the second auxiliary expansion unit 372 through the second bypass line 365, where the refrigerant is expanded. Accordingly, refrigerant introduced into the second auxiliary evaporator 360 through the refrigerant inlet 363*a* and refrigerant flowing to the expansion unit 310 from the indoor unit 320 exchange heat with each other.

The refrigerant discharged from the refrigerant outlet 363*b* of the second auxiliary evaporator 360 is introduced into the second connecting line 393A through the second lower temperature-refrigerant outflow line 366, while refrigerant discharged from the outdoor unit 340 is subjected to heat exchange through the expansion unit 310, and introduced into the second connecting line 393A through the sixth connecting line 388. The two refrigerants are mixed in the second connecting line 393A, and the mixed refrigerant is supplied to the compressor 330 through the lower temperature-refrigerant feeding line 391 and the first compressor line 394.

Since the flow control valve 355*a* of the first bypass line 355 is closed, refrigerant discharged from the expansion unit 310 is supplied to the outdoor unit 340 through the first auxiliary evaporator 350 without any changes.

In this heating operation, when a pressure of the refrigerant discharged from the compressor 330 is lower than a preset level, or when an outside temperature of the compressor 330 is lower than a preset level, the bypass valve 399*a* mounted on the refrigerant bypass line 399 is opened to an appropriate opening degree while an opening degree of the flow control valve 399*b* mounted on the second compressor line 395 is reduced to a corresponding level. Consequently, a part of the refrigerant discharged from the compressor 330 is bypassed to the inlet of the compressor 330 through the refrigerant bypass line 399, where the refrigerant is compressed again. Accordingly, since a pressure of refrigerant supplied to the compressor 330 is increased by the compressor 330, a pressure of refrigerant discharged from the compressor 330 is consequently increased.

An example of the state of the refrigerant in the heating operation, which is performed by the refrigeration system 300 according to the fourth embodiment of the present invention, will now be described.

Refrigerant of 25° C. discharged from the indoor unit 320 passes through the second auxiliary evaporator 360 while being cooled to 5° C., and is introduced into the expansion unit 310. More specifically, a part, for example, 50% of the refrigerant discharged from the second auxiliary evaporator 360 passes through the second bypass line 365 and the second auxiliary expansion unit 372 while being cooled to −15° C., and is introduced into the second auxiliary evaporator 360. The refrigerant of −15° C. exchanges heat with the refrigerant of 25° C. discharged from the indoor unit 320 in the second auxiliary evaporator 360. As a result, the refrigerant discharged from the second auxiliary evaporator 360 to the expansion unit 310 has a temperature of 5° C., and the refrigerant discharged from the refrigerant outlet 363*b* of the second auxiliary evaporator 360 has a temperature of 0° C.

The refrigerant of 5° C. introduced into the expansion unit 310 passes through the expansion unit 310 while being cooled to −15° C., and the refrigerant in a state of lower temperature and lower pressure is introduced into the outdoor unit 340, where the refrigerant is warmed to 10° C. The refrigerant, which is introduced into the expansion unit 310 from the outdoor unit 340, is warmed to 15° C. by heat exchange with the refrigerant expanded through the second auxiliary evaporator 360. Accordingly, since the refrigerant of 0° C. discharged from the refrigerant outlet 363*b* of the second auxiliary evaporator 360 and the refrigerant of 15° C. discharged from the outdoor unit 340 through the expansion unit 310 are introduced into the compressor 330, the mixed refrigerant in the compressor 330 has a temperature between 0° C. and 15° C., preferably about 50C.

To sum up, according to the fourth embodiment of the present invention, when a pressure of the refrigerant discharged from the compressor 330 is lower than a normal level, or when an outside temperature of the compressor 330 is lower than a normal level, due to various factors, a part of all of the refrigerant discharged from the compressor 330 is supplied to the compressor 330 again, to be further compressed, thereby causing the pressure of the refrigerant to reach the normal level. If it is required to prevent a temperature of the refrigerant discharged from the compressor 330 from excessively rising, a part of the lower temperature-refrigerant is supplied to the inlet of the compressor 330.

Next, how the cooling and heating operations are performed by a refrigeration system according to the fifth embodiment of the present invention will be described with reference to FIGS. 18 and 19.

Figure 18:
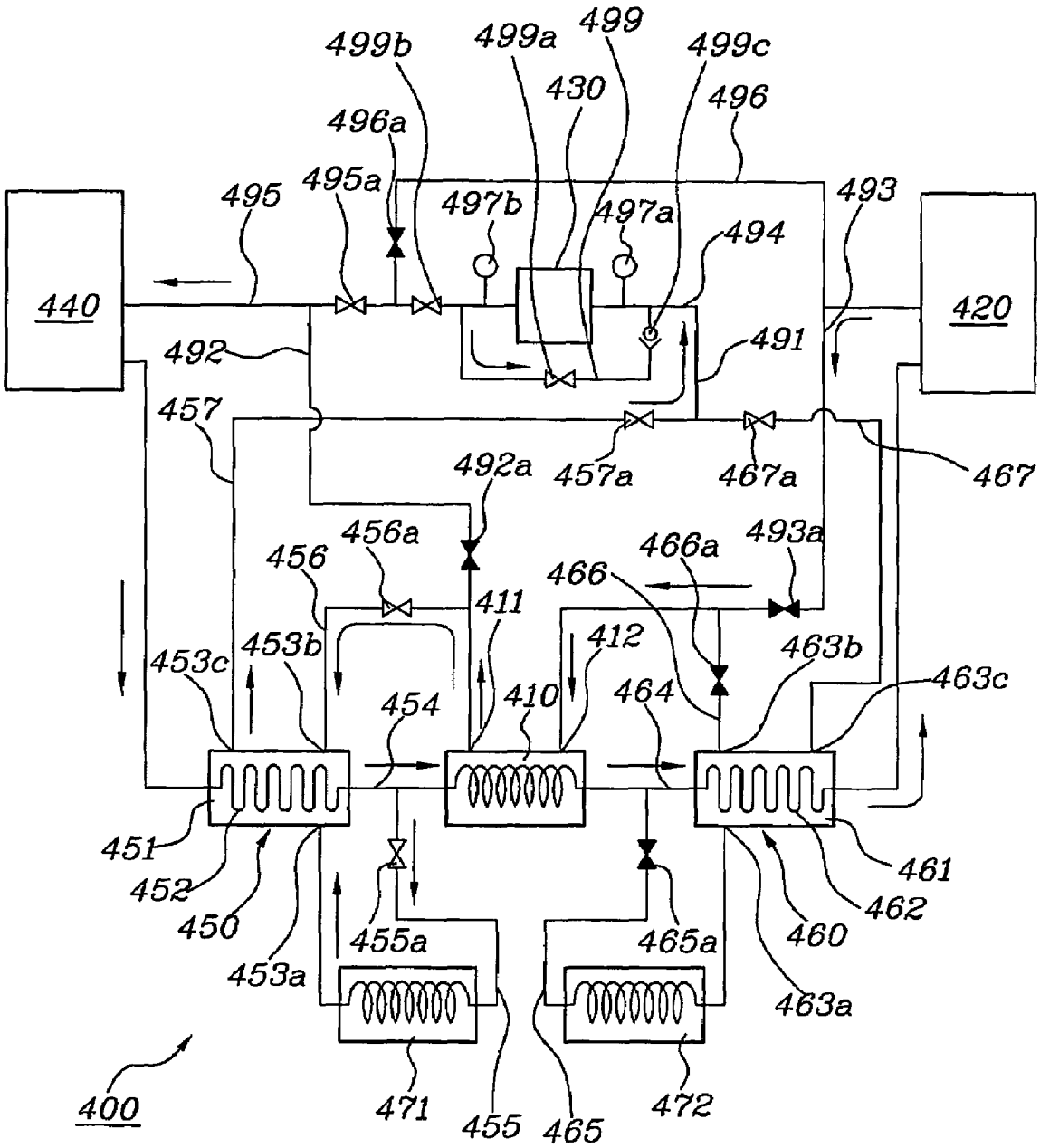
FIG. 18 is a circuit diagram showing the refrigeration system of FIG. 17 in a cooling operation.

Referring to FIG. 18, there is shown the refrigeration system according to the fifth embodiment of the present invention, which performs a cooling operation. In the cooling operation shown in FIG. 18, the ON/OFF valve 493*a* of the second connecting line 493, the ON/OFF valve 456*a* of the first higher temperature-refrigerant inflow line 456, the ON/OFF valve 457*a* of the first lower temperature-refrigerant outflow line 457, and the ON/OFF valve 495*a* and the flow control valve 499*b* of the second compressor line 495 are opened, while the ON/OFF valve 466*a* of the second higher temperature-refrigerant inflow line 466, the ON/OFF valve 492*a* of the first connecting line 492, the ON/OFF valve 467*a* of the second lower temperature-refrigerant outflow line 467 and the ON/OFF valve 496*a* of the third connecting line 496 are closed.

Consequently, refrigerant evaporates in the indoor unit 420 while absorbing heat from air in the room, and is introduced into the compressor 430 through the first higher temperature-refrigerant inflow line 456, the first lower temperature-refrigerant outflow line 457, the lower temperature-refrigerant feeding line 491 and the first compressor line 494. The refrigerant is discharged from the compressor 430, and introduced into the outdoor unit 440 through the second compressor line 495, where the refrigerant is condensed while radiating heat outside the room. The refrigerant is discharged from the outdoor unit 440, and expanded through the expansion unit 410. The refrigerant is introduced into the indoor unit 420 again, thereby accomplishing a circulation cycle of refrigerant.

At this point, the flow control valve 455*a* of the first bypass line 455 branched from the first line 454 located upstream of the expansion unit 410 is opened, while the flow control valve 465*a* of the second bypass line 465 branched from the second line 464 located downstream of the expansion unit 410 is closed.

Consequently, a part of the refrigerant to be introduced into the expansion unit 410 is introduced into the first auxiliary expansion unit 471 through the first bypass line 455, where the refrigerant is expanded. Accordingly, refrigerant introduced into the first auxiliary evaporator 450 through the refrigerant inlets 453*a* and 453*b* and refrigerant flowing to the expansion unit 410 from the outdoor unit 440 exchange heat with each other. The higher temperature-refrigerant, which is discharged from the indoor unit 420 and heat-exchanged through the expansion unit 410, and the lower temperature-refrigerant discharged from the first auxiliary expansion unit 471 are mixed, and the mixed refrigerant exchanges heat with the refrigerant discharged from the outdoor unit 440 in the first auxiliary expansion unit 450.

The refrigerant discharged from the refrigerant outlet 453*c* of the first auxiliary evaporator 450 is introduced into the first compressor line 494 through the first lower temperature-refrigerant outflow line 457, thereby allowing the refrigerant to be supplied to the compressor 430.

Since the flow control valve 465*a* of the second bypass line 465 is closed, refrigerant discharged from the expansion unit 410 is supplied to the indoor unit 420 through the second auxiliary evaporator 460 without any changes.

In this cooling operation, when a pressure of the refrigerant discharged from the compressor 430 is lower than a preset level, or when an outside temperature of the compressor 430 is lower than a preset level, the bypass valve 499*a* mounted on the bypass line 499 is opened to an appropriate opening degree while an opening degree of the flow control valve 499*b* mounted on the second compressor line 495 is reduced to a corresponding level. Consequently, a part of the refrigerant discharged from the compressor 430 is bypassed to the inlet of the compressor 430 through the refrigerant bypass line 499, where the refrigerant is compressed again. Accordingly, since a pressure of refrigerant supplied to the compressor 430 is increased by the compressor 430, a pressure of refrigerant discharged from the compressor 430 is consequently increased.

In particular, when a pressure of the refrigerant discharged from the compressor 430 is excessively low, the bypass valve 499*a* mounted on the refrigerant bypass line 499 is fully opened while the flow control valve 499*b* mounted on the second compressor line 495 is fully closed, thereby enabling all of the refrigerant discharged from the compressor 430 to be supplied to the compressor 430 again.

When a pressure of the refrigerant discharged from the compressor 430 is increased to a proper level, the bypass valve 499*a* mounted on the refrigerant bypass line 499 is closed while the flow control valve 499*b* mounted on the second compressor line 495 is fully opened, thereby restoring the normal circulation cycle of refrigerant.

An example of the state of the refrigerant in the cooling operation, which is performed by the refrigeration system 400 according to the fifth embodiment of the present invention, will now be described.

Refrigerant of 25° C. discharged from the outdoor unit 440 passes through the first auxiliary evaporator 450 while being cooled to 5° C., and is introduced into the expansion unit 410. More specifically, a part, for example, 50% of the refrigerant discharged from the first auxiliary evaporator 450 passes through the first bypass line 455 and the first auxiliary expansion unit 471 while being cooled to −15° C., and is introduced into the first auxiliary evaporator 450.

The refrigerant is introduced into the expansion unit 410, and passes through the expansion unit 410, resulting in refrigerant in a state of lower temperature of −15° C. and lower pressure. The refrigerant is introduced into the indoor unit 420, where the refrigerant is warmed to 10° C. The refrigerant of 10° C. is introduced into expansion unit 410 through the second connecting line 493, where the refrigerant is further warmed to 15° C. The refrigerant is introduced into the first auxiliary evaporator 450 through the first higher temperature-refrigerant inflow line 456, where the refrigerant is mixed with refrigerant introduced thereinto the first auxiliary evaporator 471. As a result, since the mixed refrigerant exchanges heat with the refrigerant of 25° C. discharged from the outdoor unit 440 in the first auxiliary evaporator 450, refrigerant of a predetermined temperature, preferably 5° C. is introduced into the compressor 430 through the first lower temperature-refrigerant outflow line 457, the lower temperature-refrigerant feeding line 491 and the first compressor line 494.

Figure 19:
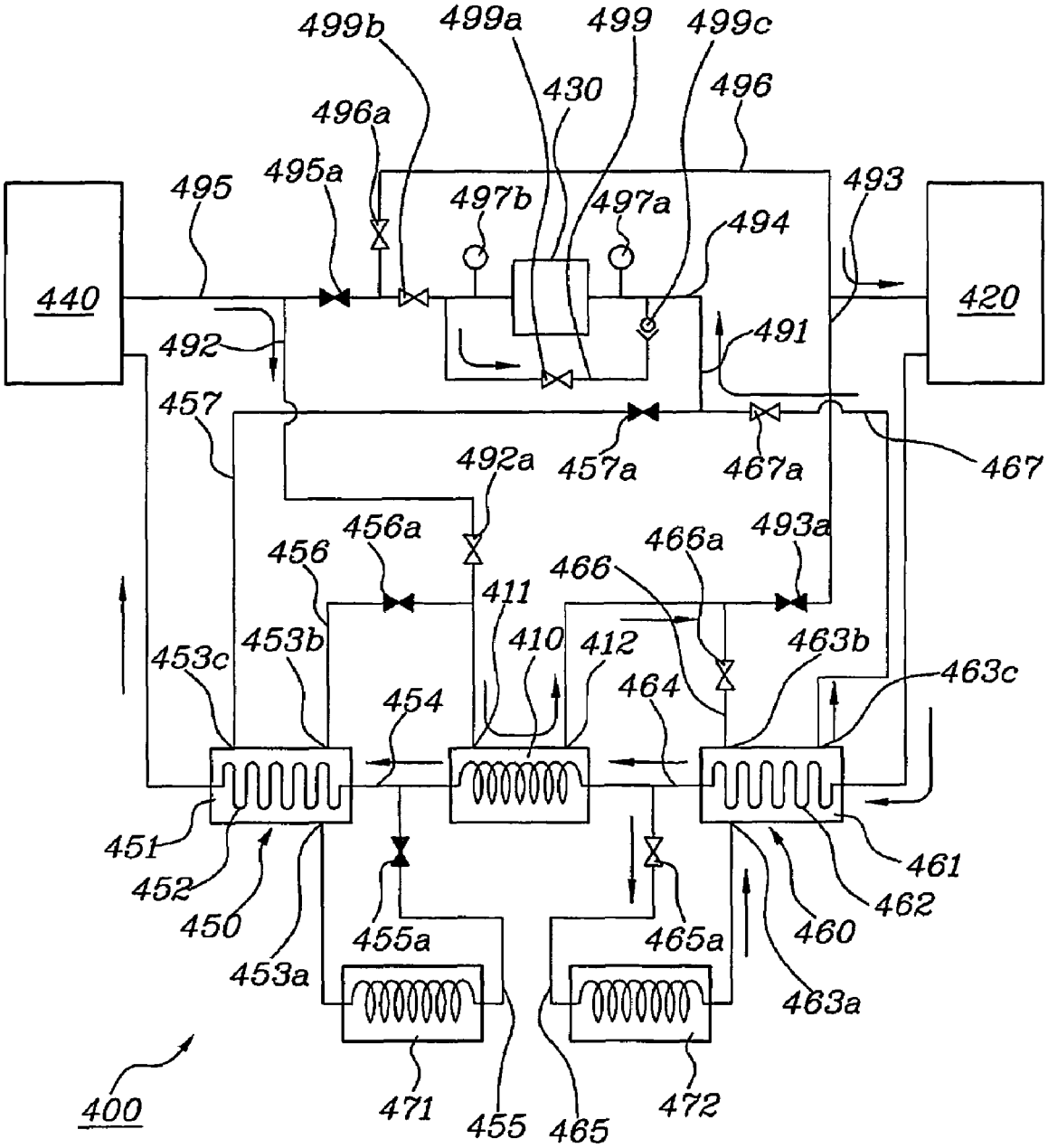
FIG. 19 is a circuit diagram showing the refrigeration system of FIG. 17 in a heating operation.

Referring to FIG. 19, there is shown the refrigeration system according to the fifth embodiment of the present invention, which performs a heating operation. In the heating operation shown in FIG. 19, the ON/OFF valve 492*a* of the first connecting line 492, the ON/OFF valve 466*a* of the second higher temperature-refrigerant inflow line 466, the ON/OFF valve 467*a* of the second lower temperature-refrigerant outflow line 467, the flow control valve 499*b* of the second compressor line 495 and the ON/OFF valve 496*a* of the third connecting line 496 are opened, while the ON/OFF valve 495*a* of the second compressor line 495, the ON/OFF valve 456*a* of the first higher temperature-refrigerant inflow line 456, the ON/OFF valve 493*a* of the second connecting line 493 and the ON/OFF valve 457*a* of the lower temperature-refrigerant outflow line 457 are closed.

Consequently, refrigerant evaporates in the outdoor unit 440 while absorbing heat from the outside air of the room, and is introduced into the compressor 430 through the first connecting line 492, the second higher temperature-refrigerant inflow line 466, the second lower temperature-refrigerant outflow line 467, the lower temperature-refrigerant feeding line 491 and the first compressor line 494. The refrigerant is discharged from the compressor 430, and introduced into the indoor unit 420 through the third connecting line 496, where the refrigerant is condensed while radiating heat to the room. The refrigerant is discharged from the indoor unit 420, and expanded through the expansion unit 410. The refrigerant is introduced into the outdoor unit 440 again, thereby accomplishing a circulation cycle of refrigerant.

At this point, the flow control valve 465*a* of the second bypass line 465 branched from the second line 464 located upstream of the expansion unit 410 is opened, while the flow control valve 455*a* of the first bypass line 455 branched from the first line 454 located downstream of the expansion unit 410 is closed.

Consequently, a part of the refrigerant to be introduced into the expansion unit 410 is introduced into the second auxiliary expansion unit 472 through the second bypass line 465, where the refrigerant is expanded. Accordingly, refrigerant introduced into the second auxiliary evaporator 460 through the refrigerant inlets 463*a* and 463*b* and refrigerant flowing to the expansion unit 410 from the indoor unit 420 exchange heat with each other. That is, the higher temperature-refrigerant, which is discharged from the outdoor unit 440 and heat-exchanged through the expansion unit 410, and the lower temperature-refrigerant discharged from the second auxiliary expansion unit 472 are mixed, and the mixed refrigerant exchanges heat with the refrigerant discharged from the indoor unit 420 in the second auxiliary expansion unit 460.

The refrigerant discharged from the refrigerant outlet 463*c* of the second auxiliary evaporator 460 is introduced into the first compressor line 494 through the second lower temperature-refrigerant outflow line 467, thereby allowing the refrigerant to be supplied to the compressor 430.

Since the flow control valve 455*a* of the first bypass line 455 is closed, refrigerant discharged from the expansion unit 410 is supplied to the outdoor unit 440 through the first auxiliary evaporator 450 without any changes.

In this heating operation, when a pressure of the refrigerant discharged from the compressor 430 is lower than a preset level, or when an outside temperature of the compressor 430 is lower than a preset level, the bypass valve 499*a* mounted on the refrigerant bypass line 499 is opened to an appropriate opening degree while an opening degree of the flow control valve 499*b* mounted on the second compressor line 495 is reduced to a corresponding level. Consequently, a part of the refrigerant discharged from the compressor 430 is bypassed to the inlet of the compressor 430 through the refrigerant bypass line 499, where the refrigerant is compressed again. Accordingly, since a pressure of refrigerant supplied to the compressor 430 is increased by the compressor 430, a pressure of refrigerant discharged from the compressor 430 is consequently increased.

An example of the state of the refrigerant in the heating operation, which is performed by the refrigeration system 400 according to the fifth embodiment of the present invention, will now be described.

Refrigerant of 25° C. discharged from the indoor unit 420 passes through the second auxiliary evaporator 460 while being cooled to 5° C., and is introduced into the expansion unit 410. More specifically, a part, for example, 50% of the refrigerant discharged from the second auxiliary evaporator 460 passes through the second bypass line 465 and the second auxiliary expansion unit 472 while being cooled to −15° C., and is introduced into the second auxiliary evaporator 460. The refrigerant is introduced into the expansion unit 410, and passes through the expansion unit 410, resulting in refrigerant in a state of lower temperature of −15° C. and lower pressure. The refrigerant is introduced into the outdoor unit 440, where the refrigerant is warmed to 10° C. The refrigerant of 10° C. is introduced into expansion unit 410 through the second connecting line 492, where the refrigerant is further warmed to 15° C. The refrigerant is introduced into the second auxiliary evaporator 460 through the second higher temperature-refrigerant inflow line 466, where the refrigerant is mixed with refrigerant introduced thereinto the second auxiliary evaporator 472. As a result, since the mixed refrigerant exchanges heat with the refrigerant of 25° C. discharged from the indoor unit 420 in the second auxiliary evaporator 460, refrigerant of a predetermined temperature, preferably 5° C. is introduced into the compressor 430 through the second lower temperature-refrigerant outflow line 467, the lower temperature-refrigerant feeding line 491 and the first compressor line 494.

To sum up, according to the fifth embodiment of the present invention, when a pressure of the refrigerant discharged from the compressor 430 is lower than a normal level, or when an outside temperature of the compressor 430 is lower than a normal level, due to various factors, a part of all of the refrigerant discharged from the compressor 430 is supplied to the compressor 430 again, to be further compressed, thereby causing the pressure of the refrigerant to reach the normal level. If it is required to prevent a temperature of the refrigerant discharged from the compressor 430 from excessively rising, a part of the lower temperature-refrigerant is supplied to the inlet of the compressor 430.

INDUSTRIAL APPLICABILITY

As described above, the present invention provides a refrigeration system of an air conditioning apparatus with a bypass line connected between an inlet and an outlet of a compressor, in which when a pressure of the refrigerant discharged from the compressor is lower than a normal level, or when an outside temperature of the compressor is lower than a normal level, a part of all of the refrigerant discharged from the compressor is supplied to the compressor 430 to be further compressed, thereby causing the pressure of the refrigerant to reach the normal level and thus improving stability of the refrigeration system.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A refrigeration system of an air conditioning apparatus to cool or heat air within a space by using phase change of refrigerant, the refrigeration system comprising:

an expansion unit to execute adiabatic expansion of refrigerant;

an indoor unit with a heat exchanger;

a compressor to execute adiabatic compression of the refrigerant;

an outdoor unit with a heat exchanger; and a bypass line connected between an inlet and an outlet of the compressor to bypass at least a part of the refrigerant discharged from the outlet of the compressor to the inlet of the compressor, when a pressure of the discharged refrigerant is lower than a preset level or the temperature of outside air of the compressor is lower than a preset level, wherein refrigerant condensed in the indoor unit or the outdoor unit is introduced into the expansion unit through a plurality of auxiliary evaporators which are connected to each other in series or in parallel with respect to the flow of the refrigerant for heat exchange.

2. The refrigeration system of an air conditioning apparatus as set forth in claim 1, wherein a part of the refrigerant to be introduced into the expansion unit is expanded in at least one auxiliary expansion unit under the adiabatic condition, and supplied to the compressor through the plurality of auxiliary evaporators for heat exchange.

3. The refrigeration system of an air conditioning apparatus as set forth in claim 2, wherein the at least one auxiliary expansion unit is comprised of a plurality of auxiliary expansion units which are connected to each other in series or in parallel with respect to the flow of the refrigerant.

4. The refrigeration system of an air conditioning apparatus as set forth in claim 1, wherein a part of the refrigerant to be introduced into the expansion unit is expanded in at least one auxiliary expansion unit under the adiabatic condition, and the refrigerant discharged from the at least one auxiliary expansion unit is mixed with the refrigerant evaporated in the outdoor or the indoor, and supplied to the compressor through the plurality of auxiliary evaporators.

5. The refrigeration system of an air conditioning apparatus as set forth in claim 4, wherein the at least one auxiliary expansion unit is comprised of a plurality of auxiliary expansion units which are connected to each other in series or in parallel with respect to the flow of the refrigerant.

6. The refrigeration system of an air conditioning apparatus as set forth in claim 1, wherein a part of the refrigerant to be introduced into the expansion unit is expanded in at least one auxiliary expansion unit under the adiabatic condition, and the refrigerant discharged from the at least one auxiliary expansion unit and subjected to heat exchange in the plurality of auxiliary evaporators is mixed with the refrigerant evaporated in the outdoor or the indoor and subjected to heat exchange in the expansion unit, and supplied to the compressor.

7. The refrigeration system of an air conditioning apparatus as set forth in claim 6, wherein the at least one auxiliary expansion unit is comprised of a plurality of auxiliary expansion units which are connected to each other in series or in parallel with respect to the flow of the refrigerant.

8. The refrigeration system of an air conditioning apparatus as set forth in claim 1, wherein a part of the refrigerant to be introduced into the expansion unit is expanded in at least one auxiliary expansion unit under the adiabatic condition, and the refrigerant discharged from the at least one auxiliary expansion unit is mixed with the refrigerant evaporated in the outdoor or the indoor and subjected to heat exchange in the expansion unit, and supplied to the compressor.

9. The refrigeration system of an air conditioning apparatus as set forth in claim 8, wherein the at least one auxiliary expansion unit is comprised of a plurality of auxiliary expansion units which are connected to each other in series or in parallel with respect to the flow of the refrigerant.

* * * * *